US010199005B2

(12) United States Patent
Kong et al.

(10) Patent No.: US 10,199,005 B2
(45) Date of Patent: Feb. 5, 2019

(54) DISPLAY DRIVING CIRCUIT CONFIGURED TO SECURE SUFFICIENT TIME TO STABILIZE CHANNEL AMPLIFIERS AND DISPLAY DEVICE COMPRISING THE SAME

(71) Applicant: Samsung Electronics Co., Ltd., Suwon-si, Gyeonggi-do (KR)

(72) Inventors: Ki-ho Kong, Suwon-si (KR); Hong-keun Yune, Seoul (KR); Jee-hwal Kim, Seoul (KR); Jin-hong Hwang, Gwacheon-si (KR); Seung-hyun An, Suwon-si (KR); Yang-hyo Kim, Suwon-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 15/468,334

(22) Filed: Mar. 24, 2017

(65) Prior Publication Data

US 2017/0287429 A1 Oct. 5, 2017

(30) Foreign Application Priority Data

Mar. 29, 2016 (KR) ..... 10-2016-0037871

(51) Int. Cl.
*G09G 3/36* (2006.01)

(52) U.S. Cl.
CPC ..... *G09G 3/3685* (2013.01); *G09G 3/3607* (2013.01); *G09G 3/3674* (2013.01); *G09G 3/3688* (2013.01); *G09G 2310/027* (2013.01); *G09G 2310/0275* (2013.01); *G09G 2310/0286* (2013.01); *G09G 2310/0291* (2013.01); *G09G 2310/08* (2013.01); *G09G 2330/021* (2013.01)

(58) Field of Classification Search
CPC ..... G09G 3/3685
USPC ..... 345/214
See application file for complete search history.

(56) References Cited

U.S. PATENT DOCUMENTS

| | | | | |
|---|---|---|---|---|
| 7,800,573 | B2 | 9/2010 | Woo et al. | |
| 8,144,100 | B2 | 3/2012 | Woo et al. | |
| 8,179,345 | B2 | 5/2012 | Woo et al. | |
| 2005/0134546 | A1* | 6/2005 | Woo | G09G 3/3688 345/100 |
| 2006/0214898 | A1* | 9/2006 | Woo | G09G 3/3688 345/90 |
| 2011/0032245 | A1 | 2/2011 | Inokuchi | |
| 2011/0148954 | A1 | 6/2011 | Tobita et al. | |
| 2012/0188224 | A1* | 7/2012 | Lee | G09G 3/20 345/214 |

(Continued)

*Primary Examiner* — Long D Pham
(74) *Attorney, Agent, or Firm* — Harness, Dickey & Pierce, P.L.C.

(57) ABSTRACT

A display driving circuit and a display device including the display driving circuit are disclosed. The display driving circuit includes: a data driver including a first channel amplifier operating based on first pixel data and a second channel amplifier operating based on second pixel data and configured to drive first and second pixels of a display panel based on the first pixel data and the second pixel data of a first line; and a data comparator configured to compare the first pixel data with the second pixel data and determine operation states of the first channel amplifier and the second channel amplifier on a comparison result, before a first horizontal period in which the first pixel and the second pixel are driven.

19 Claims, 20 Drawing Sheets

(56) References Cited

U.S. PATENT DOCUMENTS

| | | | | |
|---|---|---|---|---|
| 2013/0111102 | A1 | 5/2013 | Kim | |
| 2014/0253532 | A1* | 9/2014 | Woo | G09G 5/00 345/212 |
| 2014/0320464 | A1 | 10/2014 | Ryu et al. | |
| 2015/0062194 | A1 | 3/2015 | Chuang et al. | |

* cited by examiner

DISPLAY DRIVING CIRCUIT CONFIGURED TO SECURE SUFFICIENT TIME TO STABILIZE CHANNEL AMPLIFIERS AND DISPLAY DEVICE COMPRISING THE SAME

CROSS-REFERENCE TO RELATED APPLICATION

This application claims the benefit of Korean Patent Application No. 10-2016-0037871, filed on Mar. 29, 2016, in the Korean Intellectual Property Office, the disclosure of which is incorporated herein in its entirety by reference.

BACKGROUND

Example embodiments of the inventive concepts relate to a semiconductor device. For example, at least some example embodiments relate to a display driving circuit for driving a display panel to display an image on the display panel, and/or a display device including the display driving circuit.

SUMMARY

In one example embodiment, a display device includes a display panel for displaying an image and a display driving circuit for driving the display panel. The display driving circuit may drive the display panel by receiving image data from an external host and transmitting an image signal corresponding to the received image data to data lines of the display panel. Recently, as sizes and resolutions of display panels increase, research into reducing power consumed by display driving circuits has been conducted.

Some example embodiments of the inventive concepts provide a display driving circuit that reduces power consumption and/or a display device including the display driving circuit.

According to an example embodiment of the inventive concepts, there is provided a display driving circuit including a data driver including a first channel amplifier configured to drive a first data line connected to a first group of pixels of a display panel, the first group of pixels includes a first pixel associated with a first gate line of the display panel, and a second channel amplifier configured to drive a second data line connected to a second group of pixels of the display panel, the second group of pixels includes a second pixel associated with the first gate line; and a data comparator configured to compare the first pixel data corresponding to the first pixel with the second pixel data corresponding to the second pixel, and configured to determine operation states of the first channel amplifier and the second channel amplifier based on a comparison result, before a first horizontal period in which the first pixel and the second pixel are driven.

According to another example embodiment of the inventive concepts, there is provided a display device including: a display panel including a plurality of pixels arranged in a matrix form; a data driver including a first channel amplifier configured to drive a first data line connected to first pixels of the display panel based on first pixel data associated with a plurality of gate lines of the display panel, a second channel amplifier configured to drive a second data line connected to second pixels of the display panel based on second pixel data associated with the plurality of gate lines; and a timing controller configured to compare first pixel data with second pixel data associated with a $(k+1)^{th}$ gate line (k is a positive integer) among the plurality of gate lines during a $k^{th}$ horizontal period, and to determine whether to turn on or turn off the second channel amplifier for a $(k+1)^{th}$ horizontal period based on a comparison result, before the $(k+1)^{th}$ horizontal period starts.

According to another example embodiment, of the inventive concepts, there is provided a driving circuit configured to drive a display panel during at least a first horizontal period and a second horizontal period, the driving circuit including a controller configured to determine which ones of a first channel amplifier and a second channel amplifier to enable to amplify pixel data associated with a second gate line of the display panel during the second horizontal period based on the pixel data associated with a first gate line and the second gate line during the first horizontal period such that ones of the first channel amplifier and the second channel amplifier that are disabled during the first horizontal period and determined to be enabled during the second horizontal period are re-enabled prior to a start of the second horizontal period.

BRIEF DESCRIPTION OF THE DRAWINGS

Example embodiments of the inventive concepts will be more clearly understood from the following detailed description taken in conjunction with the accompanying drawings in which.

DETAILED DESCRIPTION

A display device according to an example embodiment of the inventive concepts may be an electronic device having an image display function. For example, the electronic device may include at least one of a smart phone, a tablet personal computer (PC), a mobile phone, a video phone, an e-book reader, a desktop computer, a laptop computer, a netbook computer, a personal digital assistant (PDA), a portable multimedia player (PMP), an MP3 player, a mobile medical instrument, a camera, and a wearable device (e.g., a head-mounted device (HMD) such as electronic glasses, smart garments, a smart bracelet, a smart necklace, electronic accessory, electronic tattoos, a smart watch, or the like).

According to some example embodiments, the display device may be a smart home appliance having an image display function. The smart home appliance may include, for example, at least one of a television (TV), a digital video disk (DVD) player, an audio player, a refrigerator, an air conditioner, a vacuum cleaner, an oven, a microwave oven, a washing machine, an air purifier, a set-top box, a TV box (e.g., Samsung HomeSync™, Apple TV™, Google TV™, or the like), a game console, an electronic dictionary, an electronic key, a camcorder, and an electronic photo frame.

According to some example embodiments, the display device may include at least one of various medical devices (e.g., a magnetic resonance angiography (MRA) device, a magnetic resonance imaging (MRI) device, a computed tomography (CT) device, a photographing device, an ultrasound device, etc.), a navigation device, a global positioning system (GPS) receiver, an event data recorder (EDR), a flight data recorder (FDR), an automobile infotainment device, marine electronics (e.g., a navigation device for vessels, a gyrocompass for vessels, etc.), avionics, a security device, a vehicle head unit, an industrial robot, a domestic robot, an automatic teller's machine (ATM), and a point of sales (POS) terminal.

According to some example embodiments, the display device may include at least one of furniture having an image display function, portions of a building/a structure, an electronic board, an electronic signature receiving device, a projector, and diverse measurement devices (e.g., a water meter, an electricity meter, a gas meter, a radio wave meter, etc.). An electronic device including the display device according to various example embodiments may be one of the above-described devices or a combination thereof. Also, the display device may be a flexible device. However, the display device according to various example embodiments is not limited thereto.

Hereinafter, the display device according to various example embodiments will be described with reference to the attached drawings.

Figure 1:
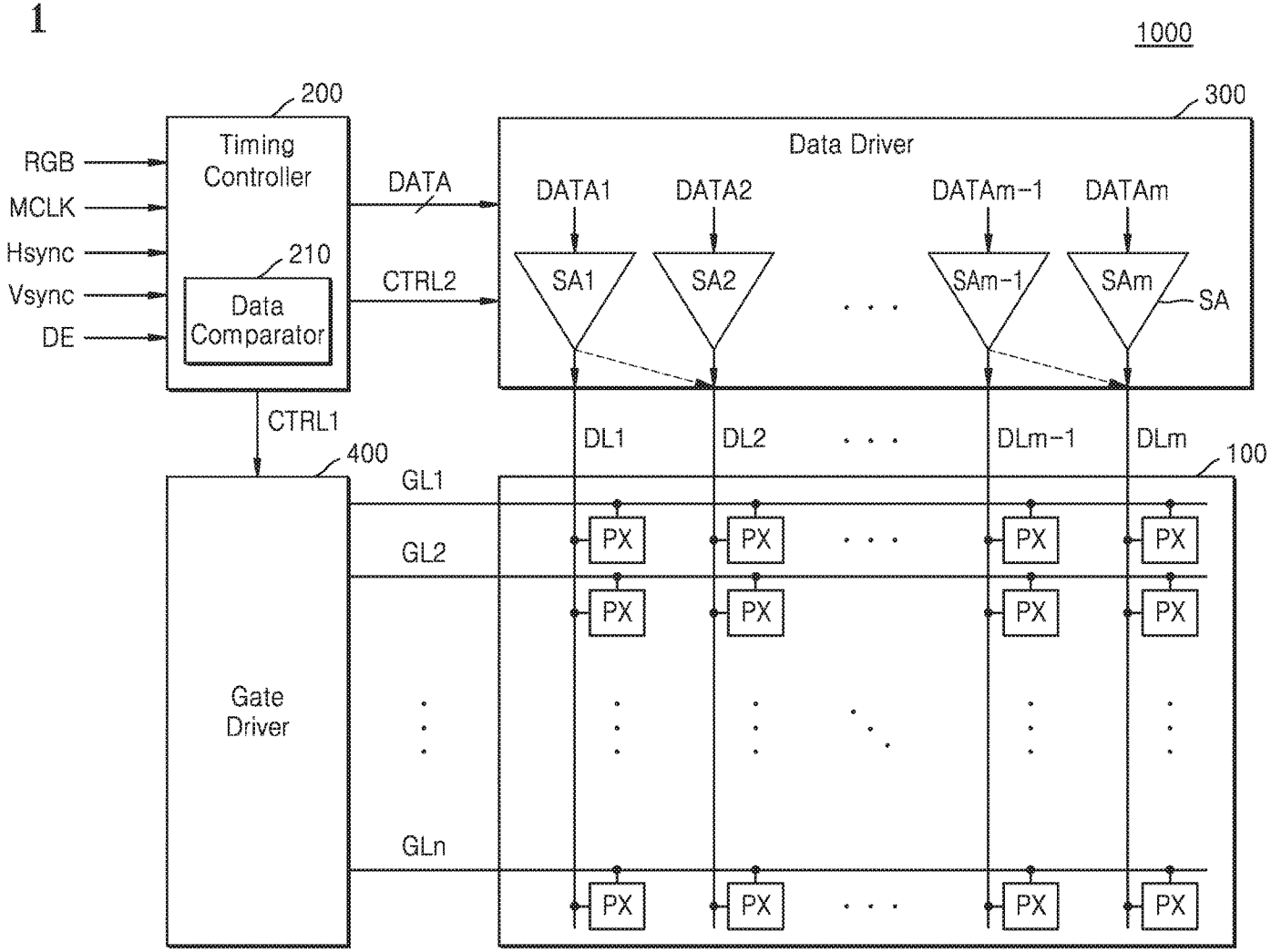
FIG. 1 is a block diagram of a display device according to an example embodiment.

FIG. 1 is a block diagram of a display device according to an example embodiment.

Referring to FIG. 1, a display device 1000 may include a display panel 100, a timing controller 200, a data driver 300, and a gate driver 400.

The display panel 100 may include pixels PX arranged in a matrix form and may display an image in a frame unit. The display panel 100 may embodied as one of a liquid crystal display (LCD), a light emitting diode (LED) display, an organic light-emitting diode (OLED) display, an active-matrix OLED (AMOLED) display, an electrochromic display (ECD), a digital mirror device (MID), an actuated mirror device (AMD), a grating light valve (GLV), a plasma display panel (PDP), an electro luminescent display (ELD), and a vacuum fluorescent display (WI)) and may be a flat panel display or a flexible display of other types. For convenience, the display panel 100 may be an LCD panel.

The display panel 100 includes first to $n^{th}$ gate lines GL1 to GLn arranged in a row direction, first to $m^{th}$ data lines DL1 to DLm arranged in a column direction, and a plurality of pixels formed at intersection points where the first to $n^{th}$ gate lines GL1 to GLn intersect the first to $m^{th}$ data lines DL1 to DLm. Pixels connected to the first data line DL1 may be referred to as a first pixel group of pixels and other pixels connected to the second data line DU2 may be referred to as a second pixel group of pixels. As such, pixels connected to the $m^{th}$ data line DLm may be referred to as the m-th group of pixels. The display panel 100 includes horizontal lines (or rows), and one horizontal line has pixels PX connected to one gate line. Hereinafter, the horizontal line is simply referred to as a line. Pixels PX of one line may be driven by the data driver 300 during one horizontal period of one frame, and pixels PX of another line may be driven by the data driver 300 during a next horizontal period of the frame. For example, pixels PX connected to the first gate line GL1 may be driven during a first horizontal period, and pixels PX connected to the second gate line GL2 may be driven during a second horizontal period.

According to gate-on signals output from the gate driver 400, the first to $n^{th}$ gate lines GL1 to GLn are sequentially selected, and as grayscale voltages corresponding to the pixels PX are applied, through the first to $m^{th}$ data lines DL1 to DLm, to the pixels PX connected to the first to $n^{th}$ gate lines GL1 to GLn that are sequentially selected, a display operation may be performed.

The gate driver 400 may sequentially provide the gate-on signals to the first to $n^{th}$ gate lines GL1 to GLn and may sequentially select the first to $n^{th}$ gate lines GL1 to GLn, in response to a gate control signal CTRL1 provided from the timing controller 200. For example, the gate control signal CTRL1 may include a gate start pulse (GSP) commanding a start of an output of the gate-on signals, a gate shift clock (GSC) controlling an output timing of the gate-on signals, and the like. When the GSP is applied to the gate driver 400, the gate driver 400 may sequentially generate the gate-on signals (e.g., a logic low gate voltage) and may sequentially provide the generated gate-on signals to the first to $n^{th}$ gate lines GL1 to GLn, in response to the GSC. In this case, during a period when the gate-on signals are not provided to the first to $n^{th}$ gate lines GL1 to GLn, gate-off signals (e.g., a logic high gate voltage) may be provided to the first to $n^{th}$ gate lines GL1 to GLn.

In response to a data control signal CTRL2, the data driver 300 may convert image data DATA into image signals that are analog signals (e.g., grayscale voltages respectively corresponding to first to in $m^{th}$ pixel data DATA1 to DATAm) and may respectively provide the image signals to the first to $m^{th}$ data lines DL1 to DLm. The data driver 300 may provide image signals of one line to the first to $m^{th}$ data lines DL1 to DLm during one horizontal period (or a horizontal display period).

The data driver 300 may include first to $m^{th}$ channel amplifiers SA1 to SAm, and each of the first to $m^{th}$ channel amplifiers SA1 to SAm may drive at least one corresponding data line corresponding to each of the first to $m^{th}$ channel amplifiers SA1 to SAm by providing an image signal to the at least one corresponding data line.

In an example embodiment, according to first to $m^{th}$ pixel data DATA1 to DATAm transmitted to the first to $m^{th}$ channel amplifiers SA1 to SAm, at least some of the first to $m^{th}$ channel amplifiers SA1 to SAm may be turned off. For example, when pieces of pixel data of at least two adjacent pixels PX are the same as each other, at least one of channel amplifiers SA corresponding to the at least two adjacent pixels PX may be turned off, and a channel amplifier SA that is turned on may simultaneously drive at least two data lines DL. In other words, the channel amplifier SA that is turned on may simultaneously drive at least two pixels PX connected to at least different data lines DL.

The timing controller 200 may control overall operations of the display device 1000. The timing controller 200 may receive image data RGB and control signals (e.g., a horizontal synchronization signal Hsync, a vertical synchronization signal Vsync, a clock signal MCLK, and a data enable signal DE, etc.) from an external device (e.g., a host device (not shown)) and may generate the control signals (e. g., the gate control signal CTRL1 and the data control signal CTRL2, etc) for controlling the data driver 300 and the gate driver 400 based on the received image data RGB and control signals. Also, the timing controller 200 may convert the image data RGB, which is received from the external device, to a format of an interface specification of the data driver 300 and may transmit image data DATA to the data driver 300. The image data DATA may include first to $m^{th}$ pixel data DATA1 to DATAm of at least one line. In an example embodiment, the image data DATA may include packet data.

The timing controller 200 may analyze the first to $m^{th}$ pixel data DATA1 to DATAm of adjacent pixels PX of one line of the display panel 100 and may control an operation of the data driver 300 according to an analysis result. The timing controller 200 may analyze the first to $m^{th}$ pixel data DATA1 to DATAm and generate the data control signal CTRL2 for controlling the operation of the data driver 300 based on the analysis.

In an example embodiment, the timing controller 200 may include a memory and a processor (not shown).

The memory may include a non-transitory computer readable medium. Examples of non-transitory computer-readable media include magnetic media such as hard disks, floppy disks, and magnetic tape; optical media such as CD ROM discs and DVDs; magneto-optical media such as optical discs; and hardware devices that are specially configured to store and perform program instructions, such as read-only memory (ROM), random access memory (RAM), flash memory, and the like. The non-transitory computer-readable media may also be a distributed network, so that the program instructions are stored and executed in a distributed fashion.

The processor may be an arithmetic logic unit, a digital signal processor, a microcomputer, a field programmable array, a programmable logic unit, a microprocessor or any other device capable of responding to and executing instructions in a defined manner.

The memory may contain computer readable code that, when executed by the processor, configures the processor as a special purpose computer to perform the operations of a data comparator 210, discussed in more detail below.

For example, the computer readable code, when executed, may configure the processor to determine which ones of a first channel amplifier SA1 and a second channel amplifier SA2 to enable to amplify pixel data associated with a second gate line GL2 during a second horizontal period H2 based on the pixel data associated with a first gate line GL1 and the second gate line GL2 during a first horizontal period H1 such that ones of the first channel amplifier and the second channel amplifier SA2 that are disabled during the first horizontal period and enabled during the second horizontal period are re-enabled prior to a start of the second horizontal period.

However, example embodiments of the inventive concepts are not limited thereto, and in another example embodiment, the timing controller 200 may implemented as a logic circuit.

The data comparator 210 may compare pieces of pixel data (e.g., the first pixel data DATA1 and the second pixel data DATA2) to be provided to channel amplifiers SA (e.g., the first channel amplifier SA1 and the second channel amplifier SA2) that are adjacent to each other among the first to $m^{th}$ channel amplifiers SA1 to SAm included in the data driver 300 and, if the pieces of the pixel data, for example, the first pixel data DATA1 and the second pixel data DATA2, are determined to be the same as each other based on a comparison result, the data comparator 210 may control the channel amplifiers SA that are adjacent to each other in such a manner that one of the channel amplifiers SA is turned on and the channel amplifier that is turned on drives multiple data lines DL. In this case, the data comparator 210 may control other channel amplifiers SA to be turned off and data lines DL corresponding to the channel amplifiers SA that are turned off to receive an output of the channel amplifier SA that is turned on. Thus, according to the first to $m^{th}$ pixel data DATA1 to DATAm, the number of channel amplifiers SA that operate among the first to $m^{th}$ channel amplifiers SA1 to SAm may decrease, and thus a static current of the data driver 300 may decrease.

In an example embodiment, while the data driver 300 drives the display panel 100 based on first to $m^{th}$ pixel data DATA1 to DATAm corresponding to pixels PX of a currently-selected line during a current horizontal period, the data comparator 210 may determine operation states of the first to $m^{th}$ channel amplifiers SA1 to SAm during a next horizontal period based on first to $m^{th}$ pixel data DATA1 to DATAm corresponding to adjacent pixels PX of a next line which are to be selected during the next horizontal period and may set the operation states of the first to $m^{th}$ channel amplifiers SA1 to SAm in advance before the next horizontal period starts. In this case, the adjacent pixels PX may be at least two pixels PX arranged in parallel to each other in a row direction or at least two pixels PX that output light of the same color among pixels PX arranged in parallel to one another in the row direction.

For example, when the first to $n^{th}$ gate lines GL1 to GLn are sequentially selected according to an arrangement order of the first to $n^{th}$ gate lines GL1 to GLn during each horizontal period, the data driver 300 may drives pixels PX connected to the first gate line GL1 during a current horizontal period, for example, a first horizontal period, and the data comparator 210 may determine operation states of the first to $m^{th}$ channel amplifiers SA1 to SAm during a next horizontal period, for example, a second horizontal period, based on first to $m^{th}$ pixel data DATA1 to DATAm corresponding to pixels PX connected to the second gate line GL2 and may set the operation states of the first to $m^{th}$ channel amplifiers SA1 to SAm in advance, for example, before the next horizontal period starts. For example, the second channel amplifier SA2 does not operate during the current horizontal period, but if the second channel amplifier SA2 needs to operate during the next horizontal period, the data comparator 210 may turn on the second channel amplifier SA2 before the next horizontal period starts.

When channel amplifiers SA that have been turned off are turned on, a stabilization time (or a wake-up time) may be desired to stably operate the channel amplifiers SA. The stabilization time may differ depending on circuit structures of the channel amplifiers SA. Conventionally, when the channel amplifiers SA are turned on after a horizontal period starts, it may be difficult to secure the stabilization time. In particular, as a resolution of the display panel 100 increases, one horizontal period is shortened, and thus it may be difficult for the channel amplifiers SA to normally operate.

Therefore, according to one or more example embodiments, the data driver 300 may secure the stabilization time that is sufficient for the channel amplifiers SA to stably operate by determining and setting in advance the operation states of the first to $m^{th}$ channel amplifiers SA1 to SAm during a prior horizontal period before the next horizontal period of a next line starts, based on pixel data to be driven during the next horizontal period.

In an example embodiment, the data comparator 210 may compare first to $m^{th}$ pixel data DATA1 to DATAm of pixels PX of the next line with each other, compare pixel data of pixels PX of a current line connected to a data line DL with pixel data of pixels PX of a next line connected to the same data line DL, and determine the operation states of the first to $m^{th}$ channel amplifiers SA1 to SAm according to comparison results.

For example, as described above, the data comparator 210 may compare pieces of pixel data of two adjacent pixels PX of the next line. When the pieces of the pixel data of the adjacent pixels PX are the same as each other, the data comparator 210 may compare pixel data of two pixels of a current line, which are connected to the same data line as the adjacent pixels PX, with the pixel data of the two pixels of a next line and if respective differences between the pieces of the pixel data of the two pixels of the current and next lines are less than a threshold value that is set in advance, the data comparator 210 may turn off one of two channel amplifiers SA corresponding to the two pixels.

In other words, when image signals to be output by the two adjacent channel amplifiers SA during the next horizontal period are the same as each other, and when a data transition amount of each pixel data to be provided to each of the two channel amplifiers SA during the current horizontal period and the next horizontal period (hereinafter, referred to as a data transition amount of each piece of pixel data) is less than a threshold value that is set in advance, one of the two channel amplifiers SA may be turned off. The data driver 300 may control a transmission path via which the first to $m^{th}$ channel amplifiers SA1 to SAm are output such that at least one channel amplifier SA that is turned on among at least two channel amplifiers SA drives pixels PX corresponding to the channel amplifier SA that is turned off, during the next horizontal period.

In contrast, although pieces of pixel data of two adjacent pixels PX of a next line are the same as each other, when a data transition amount of each piece of pixel data provided to two channel amplifiers SA during the current horizontal period and the next horizontal period is equal to or greater than the threshold value that is set in advance, the two channel amplifiers SA may be turned on. If the data transition amount of each piece of pixel data is equal to or greater than the threshold value that is set in advance and one channel amplifier SA drives two or more data lines DL an operation load of the channel amplifiers SA may greatly increase, and a normal image signal, for example, a gray-scale voltage corresponding to pixel data, may not be applied to each data line DL during one horizontal period. Therefore, if at least one data transition amount of each piece of pixel data is equal to or greater than the threshold value that is set in advance, the two channel amplifiers SA may operate and may drive their corresponding data lines DL.

As described above, pieces of pixel data of two adjacent pixels PX are compared with each other, and based on a comparison result, operation states of the two adjacent pixels PX during the next horizontal period are determined. However, example embodiments of the inventive concepts are not limited thereto. Pieces of pixel data of at least three adjacent pixels PX may be compared with each other, and based on comparison results, operation states of the at least three adjacent pixels PX during the next horizontal period may be determined.

Although not shown, the display device 1000 may further include a voltage generator and an interface. The voltage generator may generate various voltages used by the display panel 100 and driving circuits, for example, the timing controller 200, the data driver 300, and the gate driver 400.

The interface may include, for example, one of a red-green-blue (RGB) interface, a central processing unit (CPU) interface, a serial interface, a mobile display digital interface (MDDI), an inter integrated circuit (I2C) interface, a serial peripheral interface (SPI), a micro controller unit (MCU) interface, a mobile industry processor interface (MIPI), an embedded displayport (eDP) interface, a D-subminiature (D-sub), and an optical interface, or one of D-sub and a high-definition multimedia interface (HDMI). Additionally or alternatively, the interface may include, for example, a mobile high-definition link (MHL) interface, a secure digital (SD) card/multi-media card (MMC) interface, or an infrared data association (IrDA) standard interface. Besides the interfaces above, the interface may include various serial or parallel interfaces.

In the block diagram illustrated in FIG. 1, the gate driver 400, the data driver 300, and the timing controller 200 are shown as different functional blocks, however, example embodiments are not limited thereto. In some example embodiment, the gate driver 400, the data driver 300, and the timing controller 200 may be embodied as different semiconductor chips. However, in other example embodiment, at least two of the gate driver 400, the data driver 300, and the timing controller 200 may be embodied as one semiconductor chip. For example, the data driver 300 and the timing controller 200 may be integrated into one semiconductor chip. Also, some of the gate driver 400, the data driver 300, and the timing controller 200 may be integrated on the display panel 100. For example, the gate driver 400 may be integrated on the display panel 100.

Hereinafter, operations of the data comparator 210 and the data driver 300 of the display device 1000 according to an example embodiment will be described in more detail.

Figure 2:
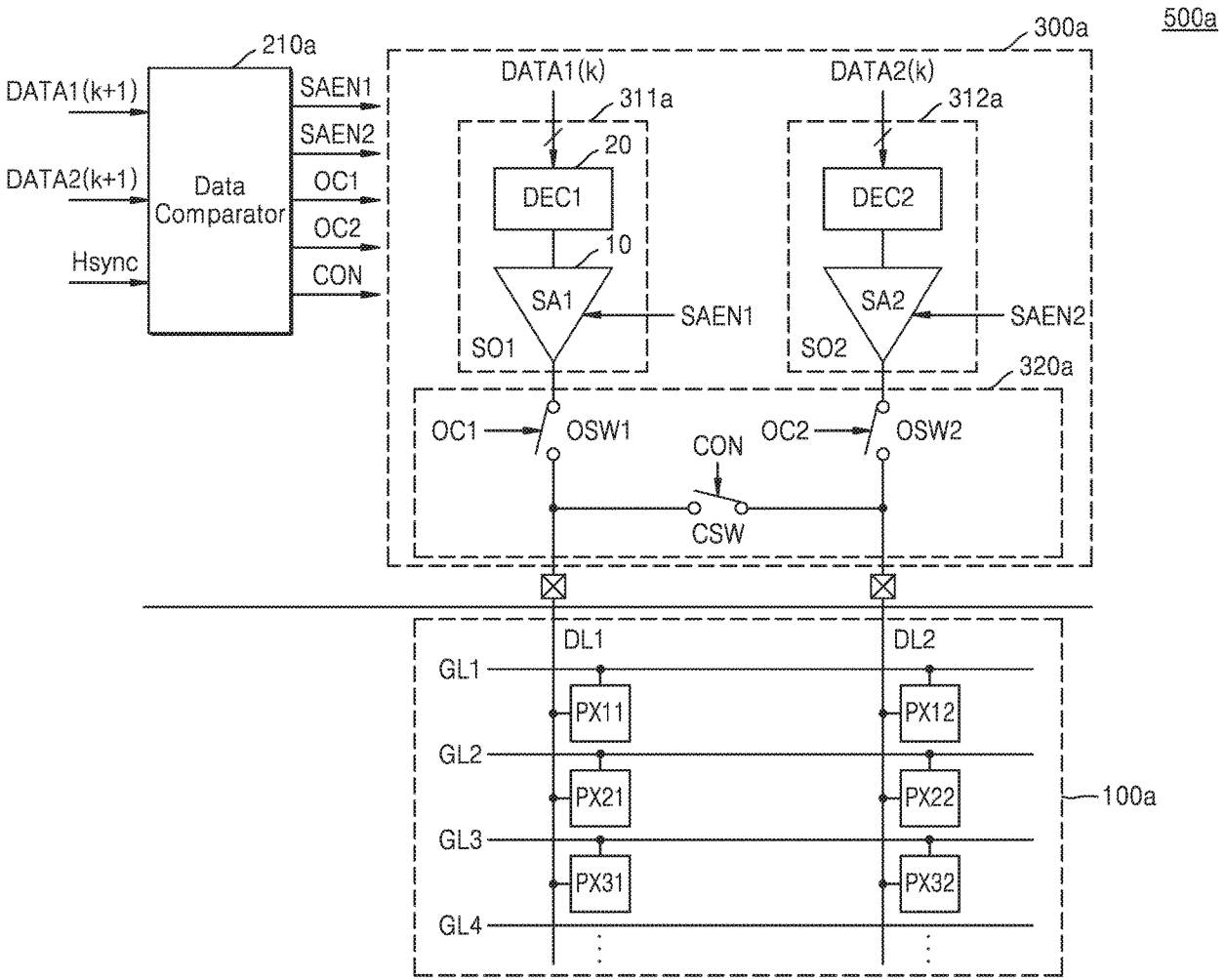
FIG. 2 is a schematic circuit diagram of a display driving circuit according to an example embodiment.
Figure 3A:
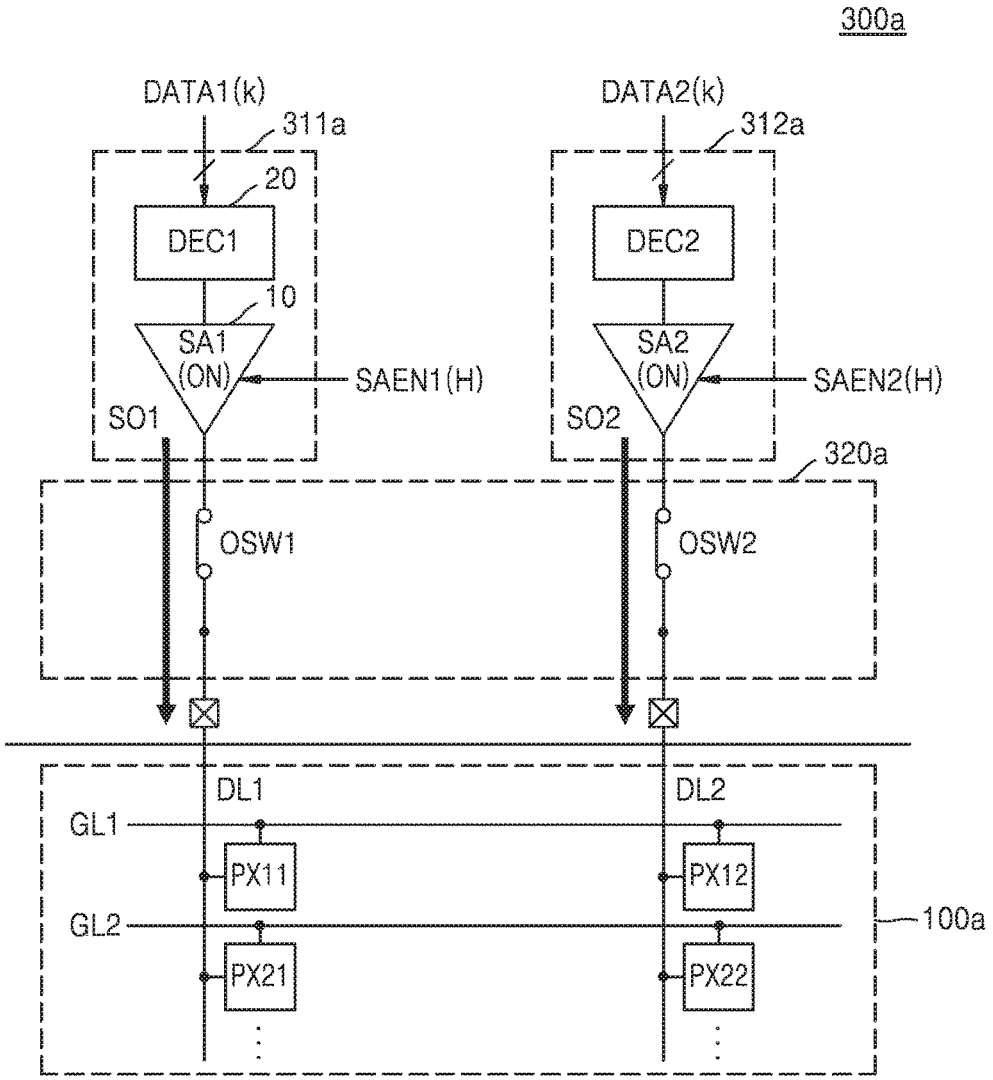
FIGS. 3A and 3B are circuit diagrams of operations of a data driver of FIG. 2.
Figure 3B:
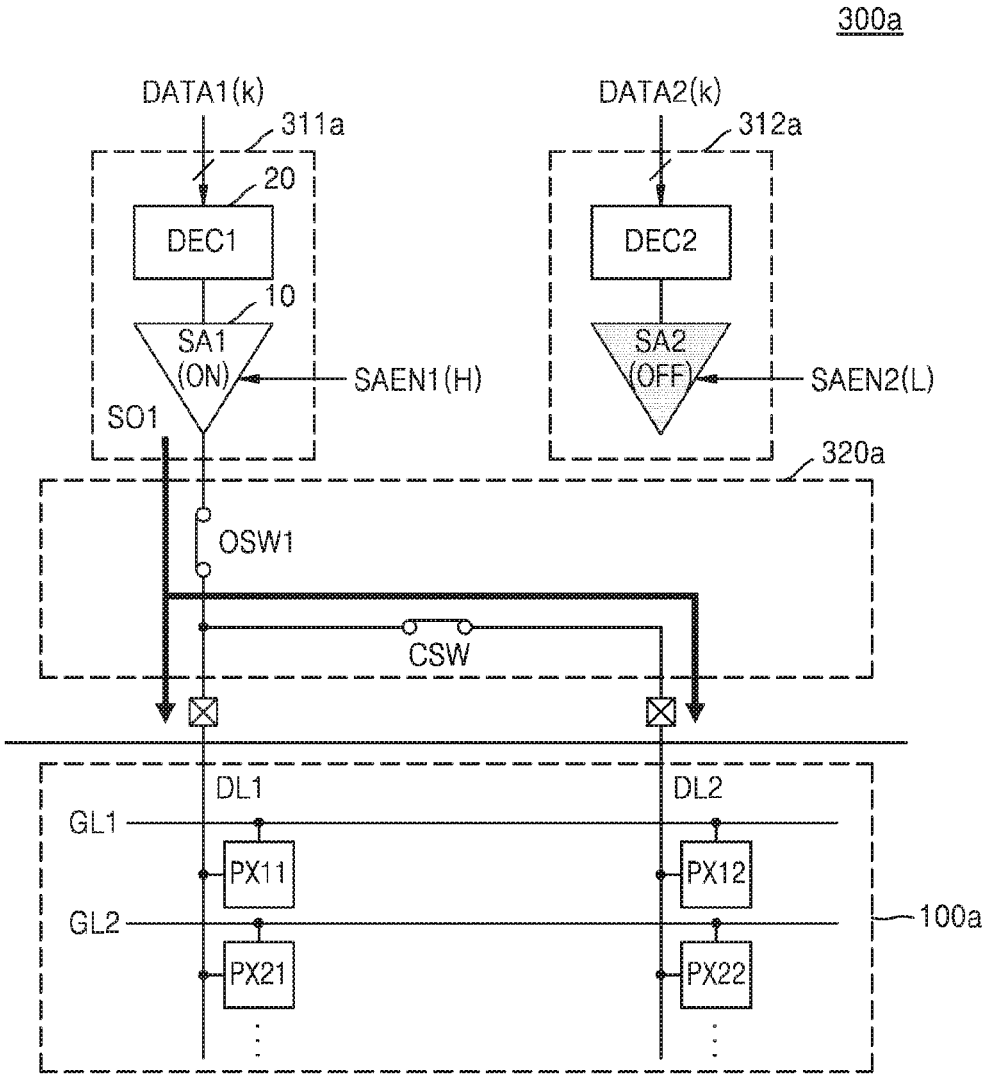

FIG. 2 is a schematic circuit diagram of a display driving circuit 500*a* according to an example embodiment. FIGS. 3A and 3B are circuit diagrams showing operations of the data driver 300 of FIG. 2, FIG. 3A shows that channel amplifiers individually operate, and FIG. 3B show that at least one channel amplifier does not operate.

FIG. 2 is a circuit diagram showing the data driver 300 and the data comparator 210 of the display device 1000 of FIG. 1 in detail. The descriptions provided with reference to FIG. 1 may be applied to the present example embodiment.

Referring to FIG. 2, the display driving circuit 500*a* may include a data comparator 210*a* and a data driver 300*a*. The display driving circuit 500*a* may further include other components shown in FIG. 1. The data comparator 210*a* and the data driver 300*a* may represent the data comparator 210 and the data driver 300 of FIG. 1.

The data comparator 210*a* may analyze pixel data and may generate control signals for controlling the data driver 300*a* based on a result of analyzing the pixel data. For example, the control signals may include a first enable signal SAEN1, a second enable signal SAEN2, a first output control signal OC1, a second output control signal OC2, and a connection control signal CON. The data comparator 210*a* may sequentially receive pixel data of a current line which corresponds to pixels (pixels of the current line) driven during a current horizontal period and pixel data of a next line which corresponds to pixels (pixels of the next line) driven during a next horizontal period after the current horizontal period. In order to distinguish the pixel data of the current line from the pixel data of the next line, first and second pixel data of the current line are indicated as DATA1(*k*) and DATA2(*k*), and first and second pixel data of the next line are indicated as DATA1(*k*+1) and DATA2(*k*+1) (where, k is a positive integer).

The data comparator 210*a* may receive and analyze the pixel data of the next line during the current horizontal period. The data comparator 210*a* may generate control signals to be provided to driving units 311*a* and 312*a* and an output controller 320*a* of the data driver 300*a* during the next horizontal period based on a result of analyzing the pixel data.

For example, the data comparator 210*a* may receive the first pixel data DATA1(*k*+1) and the second pixel data DATA2(*k*+1) of the next line and compare the first pixel data DATA1(*k*+1) with the second pixel data DATA2(*k*+1) of the next line during the current horizontal period. If it is determined that the first pixel data DATA1(*k*+1) is the same as the second pixel data DATA2(*k*+1) of the next line, the data comparator 210*a* may output a control signal for turning off one of the first and second channel amplifiers SA1 and SA2 and turning on the other thereof to the first and second channel amplifiers SA1 and SA2 at a point in time when or before the next horizontal period starts. If it is determined that the first pixel data DATA1(*k*+1) is not the same as the second pixel data DATA2(*k*+1) of the next line, the data comparator 210*a* may output a control signal for turning on all of the first and second channel amplifiers SA1 and SA2 to the first and second channel amplifiers SA1 and SA2 at a point in time when or before the next horizontal period starts.

In an example embodiment, if it is determined that the first pixel data DATA1(*k*+1) is the same as the second pixel data DATA2(*k*+1) of the next line, the data comparator 210*a* may determine data transition amounts of each piece of pixel data between the current line and the next line and may output a control signal for turning on the first and second channel amplifiers SA1 and SA2 to the first and second channel amplifiers SA1 and SA2 if each of the data transition amounts is greater than a threshold value that is set in advance. For example, the data comparator 210*a* may calculate a first data transition amount by comparing the first pixel data DATA1(*k*) of the current line with first pixel data DATA1(*k*−1) of the next line and may calculate a second data transition amount by comparing the second pixel data DATA2(*k*) of the current line with the second pixel data DATA2(*k*+1) of the next line. The transition amount may be referred to as a data difference. The data comparator 210*a* may output a control signal for turning on all of the first and second channel amplifiers SA1 and SA2 to the first and second channel amplifiers SA1 and SA2 when at least one of the first data transition amount and the second data transition amount is equal to or greater than the threshold value that is set in advance. In other words, the data comparator 210*a* may output a control signal for turning off one of the first and second channel amplifiers SA1 and SA2 to the first and second channel amplifiers SA1 and SA2 when the first pixel data DATA1(*k*+1) of the next line is the same as the second pixel data. DATA2(*k*+1) thereof, and the data transition amount of the pixel data is less than the threshold value that is set in advance.

In an example embodiment, the data comparator 210*a* may generate the control signals, that is, the first enable signal SAEN1, the second enable signal SAEN2, the first output control signal OC1, the second output control signal OC2, and the connection control signal CON, in response to the horizontal synchronization signal Hsync. In another example embodiment, the data comparator 210*a* may generate each of the first enable signal SAEN1, the second enable signal SAEN2, the first output control signal OC1, the second output control signal OC2, and the connection control signal CON in response to timing signals (not shown) that are synchronized with the horizontal synchronization signal Hsync. In an example embodiment, when the first enable signal SAEN1 or the second enable signal SAEN2 transitions from a second level, for example, logic low, to a first level, for example, logic high, the transition of the first enable signal SAEN1 or the second enable signal SAEN2 may be performed at a desired (or, alternatively, a predetermined) time earlier than a transition of the horizontal synchronization signal Hsync.

The data driver 300*a* may include the driving units 311*a* and 312*a* and the output controller 320*a*. A driving unit is a unit driving circuit that forms one channel used to convert pixel data into a grayscale voltage and may be referred to as a channel driver. For convenience, FIG. 2 shows that the data driver 300*a* includes two driving units 311*a* and 312*a*, but example embodiments of the inventive concepts are not limited thereto. The number of driving units may vary depending on a resolution of a display panel 100*a* and the number of data lines driven by each driving unit.

The driving units 311*a* and 312*a* may each include a channel amplifier 10 and a decoder 20 and may convert the pixel data DATA1(*k*) and DATA2(*k*) of the current line, which are received during the current horizontal period, into image signals in order to provide the image signals to the first and second data lines DL1 and DL2.

The decoder 20 may select a gamma voltage corresponding to received pixel data from among gamma voltages that are set in advance and may output the selected gamma voltage to the channel amplifier 10. For example, the decoder 20 of the first driving unit 311*a* may select a gamma voltage corresponding to the first pixel data DATA1(*k*) from among gamma voltages that are set in advance, and the decoder 20 of the second driving unit 312*a* may select a gamma voltage corresponding to the second pixel data DATA2(*k*) from among gamma voltages. The gamma voltages may include, for example, first to $256^{th}$ voltages. In the display panel 100*a*, a grayscale of the pixels PX nonlinearly, instead of linearly, changes according to levels of voltages of the provided image signals. In order to prevent quality deterioration of an image due to gamma characteristics, gamma voltages, to which the gamma characteristics are reflected, are generated in advance and then provided to the decoder 20, and the decoder 20 selects a gamma voltage corresponding to pixel data and provides the selected gamma voltage to the channel amplifier 10.

The channel amplifier 10 may output the gamma voltage received from the decoder 20 as an image signal. The channel amplifier 10 may be embodied as a differential amplifier. The gamma voltage received from the decoder 20 may be applied to one of two input terminals of the channel amplifier 10, and the other of the input terminals of the channel amplifier 10 may be connected to an output terminal of the channel amplifier 10. Thus, the channel amplifier 10 may function as a buffer that amplifies and outputs a current of input signals.

A determination as to whether the first channel amplifier SA1 and the second channel amplifier SA2 of the first driving unit 311*a* operate may be made in response to the first enable signal SAEN1 and the second enable signal SAEN2, respectively. For example, when the first enable signal SAEN1 and the second enable signal SAEN2 are at the first level, for example, logic high, the first channel amplifier SA1 and the second channel amplifier SA2 may operate, and when the first enable signal SAEN1 and the second enable signal SAEN2 are at the second level, logic low, the first channel amplifier SA1 and the second channel amplifier SA2 may not operate. When the first channel amplifier SA1 or the second channel amplifier SA2 does not operate, a static current does not flow in the first channel amplifier SA1 or the second channel amplifier SA2, and thus power consumed by the display driving circuit 500*a* may be reduced.

The output controller 320*a* may control connection of output terminals of the first and second channel amplifiers SA1 and SA2 to the first and second data lines DL1 and DL2 based on the first and second output control signals OC1 and OC2 and the connection control signal CON.

The output controller 320*a* may include first and second output control switches OSW1 and OSW2 and a connection switch CSW. The first and second output control switches OSW1 and OSW2 may be turned on or off in response to the first and second output control signals OC1 and OC2, respectively. The first output control switch OSW1 may be turned on and may provide an output SO1 (e.g., an image signal) of the first channel amplifier SM to the first data line DL1 and the second output control switch OSW2 may be turned on and may provide an output SO2 of the second channel amplifier SA2 to the second data line.

The connection switch CSW may be turned on or off in response to the connection control signal CON. The connection switch CSW may be turned on and may provide the output SO1 of the first channel amplifier SA1 to the second data line DL2 or the output SO2 of the second channel amplifier SA2 to the first data line DL1.

Referring to FIG. 3A, when the first channel amplifier SA1 and the second channel amplifier SA2 are turned on, the first and second output control switches OSW1 and OSW2 are turned on, and the connection switch CSW may be turned off. Accordingly, the output SO1 of the first channel amplifier SA1 may be provided to the first data line DL1, and the output SO2 of the second channel amplifier SA2 may be provided to the second data line DL2.

Referring to FIG. 3B, when one of the first channel amplifier SA1 and the second channel amplifier SA2 is turned off, the other of the first channel amplifier SA1 and the second channel amplifier SA2 may drive two data lines, that is, the first and second data lines DL1 and DL2. As shown in FIG. 3B, when the second channel amplifier SA2 is turned off, the first output control switch OSW1 may be turned on, and the second output control switch OSW2 may be turned off. In this case, the connection switch CSW is turned on, and thus, the output SO1 of the first channel amplifier SA1 may be provided to the first and second data lines DL1 and DL2.

Figure 4:
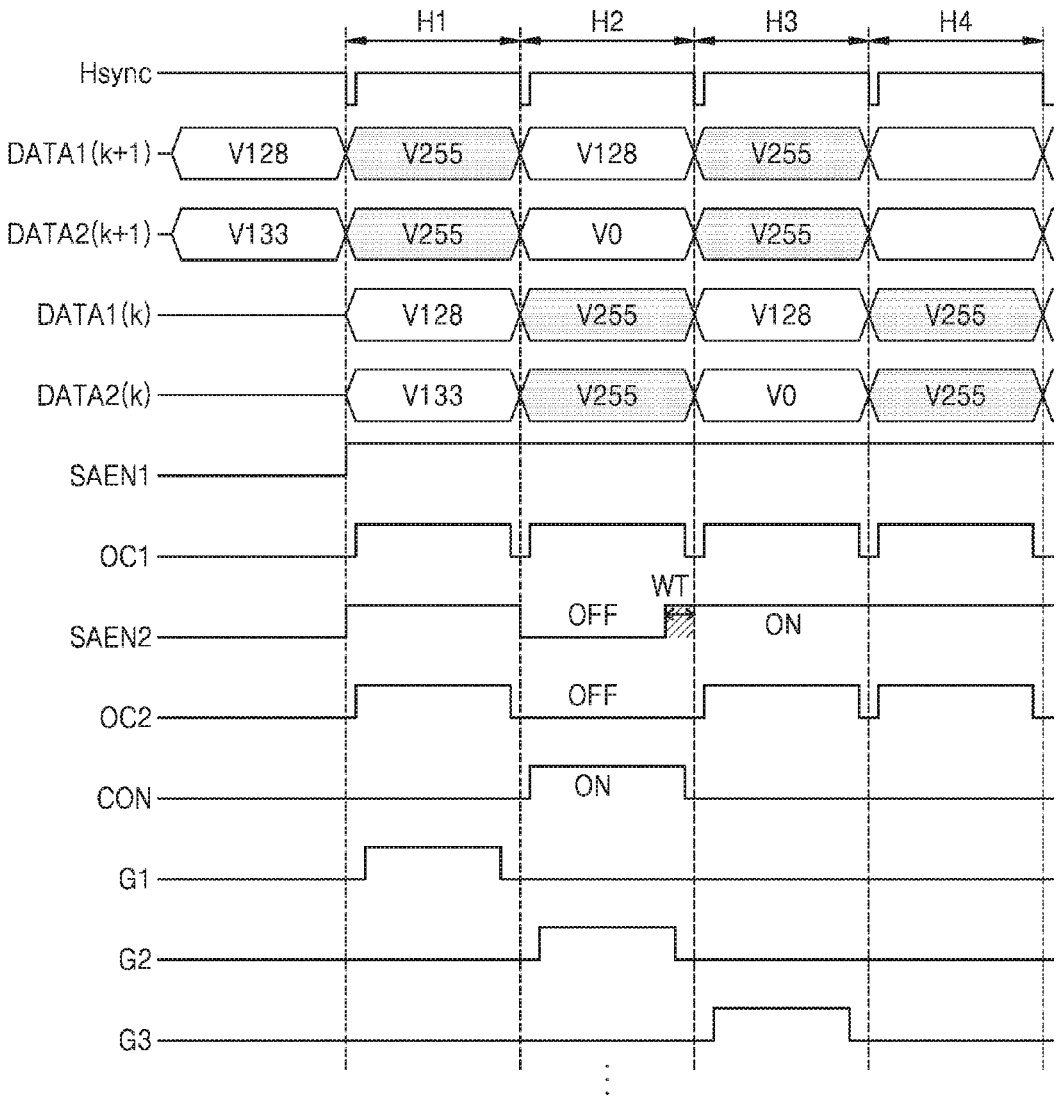
FIG. 4 is a timing diagram of the display driving circuit of FIG. 2.

FIG. 4 is a timing diagram of the display driving circuit 500*a* of FIG. 2.

Referring to FIGS. 2 and 4, first to fourth horizontal periods H1 to H4 may be respectively set based on the horizontal synchronization signal Hsync. For example, a period between a falling edge and a next falling edge of the horizontal synchronization signal Hsync may be determined as a horizontal period. First to $n^{th}$ gate lines GL1 to GLn may be sequentially selected during each of the first to fourth horizontal periods H1 to H4.

The data comparator 210*a* may receive the first pixel data DATA1(*k*+1) and the second pixel data DATA2(*k*+1) of the next line during the first horizontal period H1. The first pixel data DATA1(*k*+1) and the second pixel data DATA2(*k*+1) of the next line are pixel data provided to the first and second channel amplifiers SA1 and SA2 as the first and second pixel data DATA1(*k*) and DATA2(*k*) of the current line during the second horizontal period H2.

The first pixel data DATA1(*k*+1) and the second pixel data DATA2(*k*+1) of the next line may be the same as each other (e.g., V255). Since the first pixel data. DATA1(*k*+1) and the second pixel data DATA2(*k*+1) of the next line are the same as each other, the data comparator 210*a* may determine to turn off the second channel amplifier SA2 during the second horizontal period H2.

In an example embodiment, when the first pixel data DATA1(*k*+1) and the second pixel data DATA2(*k*+1) of the next line are the same as each other, the data comparator 210*a* may respectively compare the first pixel data DATA1(*k*) and the second pixel data DATA2(*k*) of the current line with the first pixel data DATA1(*k*+1) and the second pixel data DATA2(*k*+1) of the next line, respectively, and may analyze a data transition amount of the pixel data. The data comparator 210*a* may determine to turn off the second channel amplifier SA2 during the second horizontal period H2 when the data transition amount is less than the threshold value that is set in advance.

For example, it is assumed that the threshold value is V192. Since the first pixel data DATA1(*k*) of the current line is V128 and the first pixel data DATA1(*k*+1) of the next line is V255, the data transition amount equals to V127, which is less than the threshold value. Since the second pixel data DATA2(*k*) of the current line is V133 and the second pixel data DATA2(*k*+1) of the next line is V255, the data transition amount equals to V122, which is less than the threshold value. Therefore, the data comparator 210*a* may determine to turn off the second channel amplifier SA2 during the second horizontal period H2.

The data comparator 210*a* may turn off the second channel amplifier SA2 during the second horizontal period H2 and may output the control signals, that is, the first enable signal SAEN1 the second enable signal SAEN2, the first output control signal OC1, the second output control signal OC2, and the connection control signal CON, which control the data driver 300*a* to provide the output SO1 of the first channel amplifier SA1 to the first data line DL1 and the second data line DL2. The second enable signal SAEN2 and the second output control signal OC2 are at the second level, for example, logic low, during the second horizontal period H2, and the second channel amplifier SA2 may be turned off. The first enable signal SAEN1, the first output control signal OCE and the connection control signal CON are at the first level, for example, logic high, the first channel amplifier SA1 may be turned on, and the output SO1 of the first channel amplifier SA1 may be provided to the first data line DL1 and the second data line DL2.

During the second horizontal period H2, the data comparator 210*a* may receive the first and second pixel data DATA1(*k*+1) and DATA2(*k*+1) of the next line which are to be provided to the first and second channel amplifiers SA1 and SA2 as the first and second pixel data DATA1(*k*) and DATA2(*k*) of the current line during the third horizontal period H3. The first pixel data DATA1(*k*+1) of the next line is different from the second pixel data DATA2(*k*+1) of the next line, since the first pixel data DATA1($k$+1) is V128 and the second pixel data DATA2($k$+1) is V0.

Since the first pixel data DATA1($k$+1) is different from the second pixel data DATA2($k$+1), the data comparator 210$a$ may determine to turn on the second channel amplifier SA2 during the third horizontal period H3. The data comparator 210$a$ may output the first enable signal SAEN1, the second enable signal SAEN2, the first output control signal OC1, the second output control signal OC2, and the connection control signal CON for controlling the data driver 300$a$ in such a manner that the first and second channel amplifiers SA1 and SA2 are turned on during the third horizontal period H3 and the outputs SO1 and SO2 of the first and second channel amplifiers SA1 and SA2 are provided to the first and second data lines DL1 and DL2, respectively. The second enable signal SAEN2 and the second output control signal OC2 are at the first level, for example, logic high, and the second channel amplifier SA2 may be turned on during the third horizontal period H3.

When the second channel amplifier SA2 that has been turned off is turned on, the data comparator 210$a$ may control the second enable signal SAEN2 that controls an operation state of the second channel amplifier SA2 to be transitioned before the third horizontal period H3 starts. Accordingly, the second channel amplifier SA2 is turned on before the third horizontal period H3 starts, a stabilization time WT for the second channel amplifier SA2 to normally operate may be secured. As the second channel amplifier SA2 is stabilized during the stabilization time WT before the third horizontal period H3 starts, the second channel amplifier SA2 may output normal image signals corresponding to the second pixel data DATA2($k$) during the third horizontal period H3.

During the third horizontal period H3, the data comparator 210$a$ may receive the first and second pixel data. DATA1($k$+1) and DATA2($k$+1) of the next line which are to be provided to the first and second channel amplifiers SA1 and SA2 as the first and second pixel data DATA1($k$) and DATA2($k$) of the current line during the fourth horizontal period H4. The first and second pixel data DATA1($k$+1) and DATA2($k$+1) of the next line are the same as each other as V255.

However, the first pixel data DATA1($k$) of the current line is V128 and the first pixel data DATA1($k$+1) of the next line is V255. Thus, the data transition amount of the first pixel data DATA1 is less than the threshold value, that is, V192. However, the second pixel data DATA2($k$) of the current line is V0, and the second pixel data DATA2($k$+1) of the next line is V255. Thus, the data transition amount of the second pixel data DATA2 is greater than the threshold value that is V192. Therefore, the data comparator 210$a$ may determine to turn on the first channel amplifier and the second channel amplifier SA2 during the fourth horizontal period H4.

Figure 5:
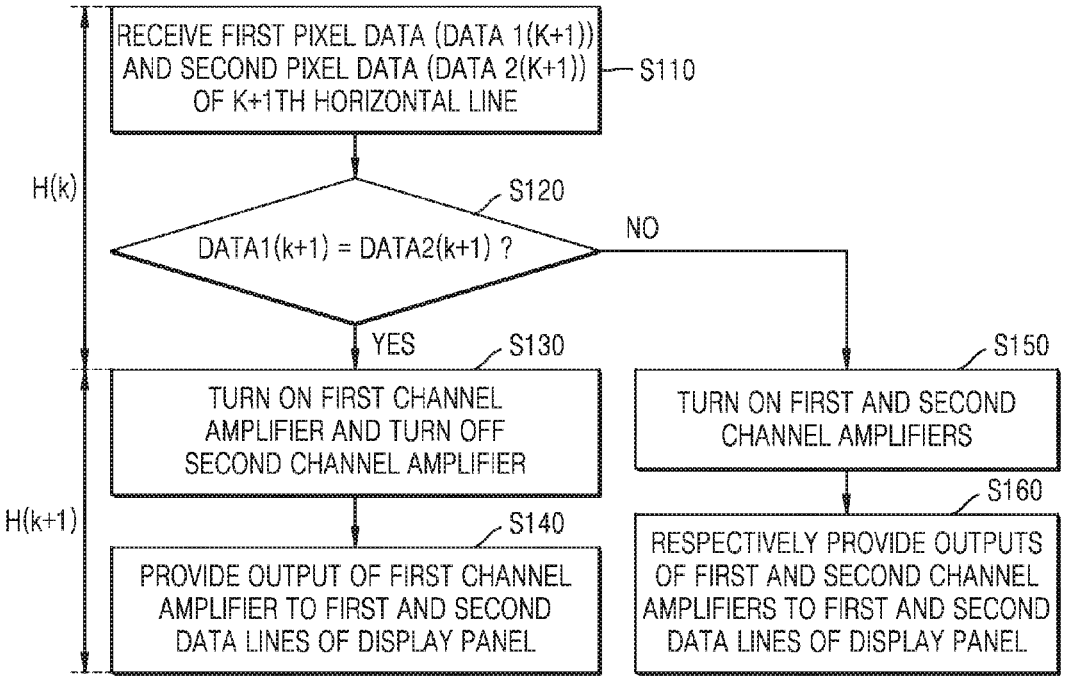
FIG. 5 is a flowchart of a method of operating a display driving circuit, according to an example embodiment.

FIG. 5 is a flowchart of a method of operating a display driving circuit, according to an example embodiment. FIG. 5 shows a method of operating the display driving circuit 500$a$ of FIG. 2, and the descriptions provided with reference to FIG. 2 are applied to the present example embodiment.

Referring to FIG. 5, in operation S110, during a $k^{th}$ horizontal period Hk, the data comparator 210$a$ receives first pixel data DATA1($k$+1) and second pixel data DATA2($k$+1) of a $(k+1)^{th}$ horizontal line.

In operation S120, the data comparator 210$a$ may compare the first pixel data DATA1($k$+1) with the second pixel data DATA2($k$+1) and may determine whether the first pixel data DATA1($k$+1) is the same as the second pixel data DATA2($k$+1). For example, the first pixel data DATA1($k$+1) and the second pixel data DATA2($k$+1) may include bits, and the data comparator 210$a$ may determine whether the first pixel data DATA1($k$+1) is the same as the second pixel data DATA2($k$+1) by comparing the first pixel data DATA1($k$+1) with the second pixel data DATA2($k$+1) from a least significant bit (LSB) to a most significant bit (MSB). The data comparator 210$a$ may determine operation states of the first channel amplifier SA1 and the second channel amplifier SA2 during the $k^{th}$ horizontal period Hk based on a comparison result and may output control signals for controlling operations and outputs of the first channel amplifier SA1 and the second channel amplifier SA2.

In operation S130, when the first pixel data DATA1($k$+1) is the same as the second pixel data DATA2($k$+1), the first channel amplifier SA1 may be turned on and the second channel amplifier SA2 may be turned off during a $(k+1)^{th}$ horizontal period H(k+1).

In operation S140, an output of the first channel amplifier SA1 may be provided to the first and second data lines DL1 and DL2 of the display panel 100$a$.

In operation 150, when the first pixel data DATA1($k$+1) is not the same as the second pixel data DATA2($k$+1), the first channel amplifier SA1 and the second channel amplifier SA2 may be turned on.

In operation S160, the output of the first channel amplifier SA1 and an output of the second channel amplifier SA2 may be respectively provided to the first data line DL1 and the second data line DL2 during the $(k+1)^{th}$ horizontal period H(k+1).

Figure 6:
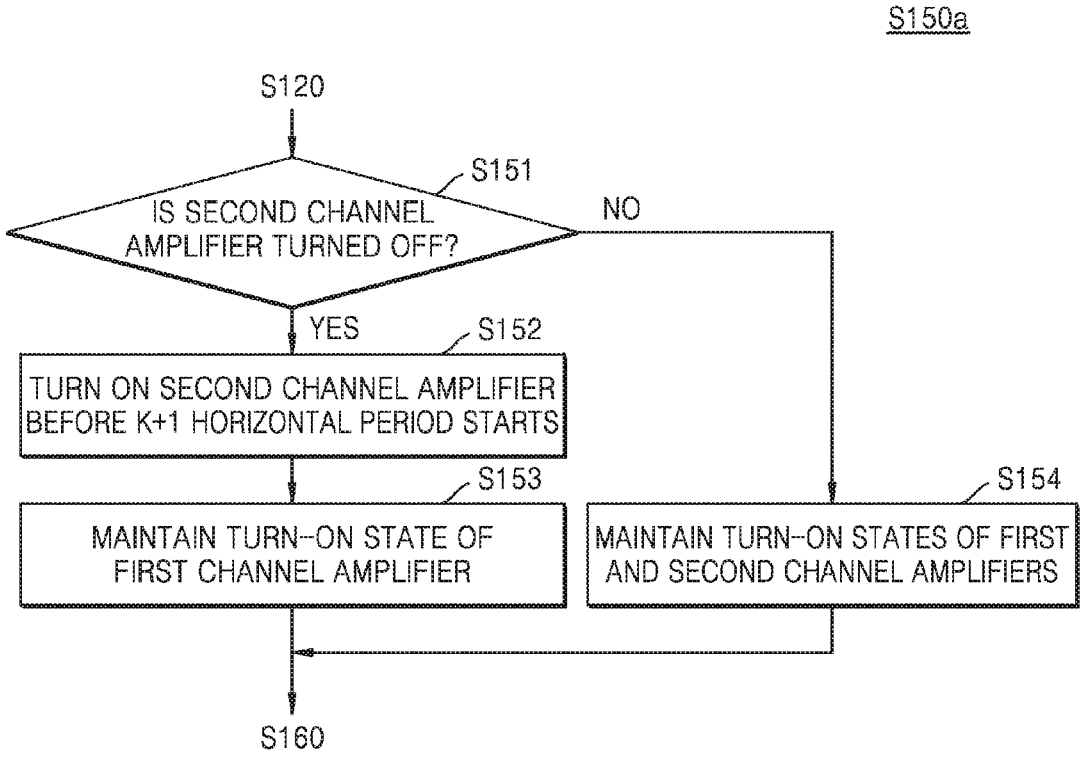
FIG. 6 is a flowchart of an example of the operation S150 of FIG. 5.

FIG. 6 is a flowchart of an example of the operation S150 of FIG. 5.

Referring to FIG. 6, in operation S151, when the first pixel data DATA1($k$+1) is not the same as the second pixel data DATA2($k$+1), the data comparator 210$a$ may determine whether the second channel amplifier SA2 is turned off.

When the second channel amplifier SA2 is turned off, in operation S152, the data comparator 210$a$ may control the second channel amplifier SA2 to be turned on before the $(k+1)^{th}$ horizontal period H(k+1) starts. The data comparator 210$a$ may control the second enable signal SAEN2, which controls the operation of the second channel amplifier SA2, to transition from the second level, for example, logic low, to the first level, for example, logic high, before the $(k+1)^{th}$ horizontal period H(k+1) starts, based on a stabilization time that is set in advance. Also, since the first channel amplifier SA1 has been turned on, the data comparator 210$a$ may control the first channel amplifier SA1 to keep being turned on.

If the second channel amplifier SA2 is not turned off, in operation S154, the data comparator 210$a$ may control the first channel amplifier SA1 and the second channel amplifier SA2 to remain turned on.

Figure 7:
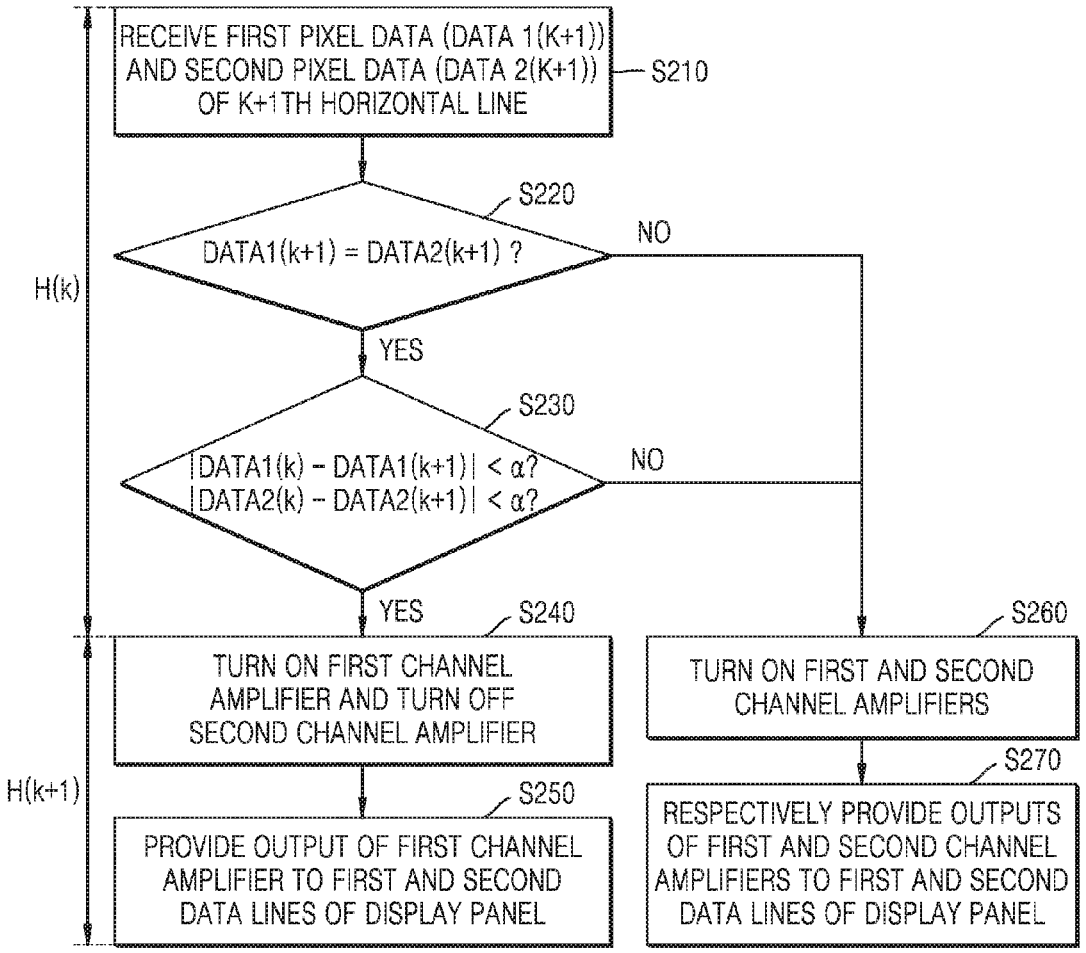
FIG. 7 is a flowchart of a method of operating a display driving circuit, according to an example embodiment.

FIG. 7 is a flowchart of a method of operating a display driving circuit, according to an example embodiment. FIG. 7 shows a method of operating the display driving circuit 500$a$ of FIG. 2, and the descriptions provided with reference to FIG. 2 are applied to the present embodiment.

The method of FIG. 7 is similar to that of FIG. 5. Therefore, only a difference between the methods of FIGS. 5 and 7 will be described.

In FIG. 7, in operation S220, the data comparator 210$a$ may determine whether the first pixel data DATA1($k$+1) is the same as the second pixel data DATA2($k$+1).

Thereafter, in operation 230, the data comparator 210$a$ may determine whether data transition amounts of the first and second pixel data DATA1 and DATA2 between the $k^{th}$ horizontal period Hk and the $(k+1)^{th}$ horizontal period H(k+1) are equal to or greater than a threshold value α that is set in advance.

The threshold value α may be set in consideration of operation performance of the channel amplifiers SA, loads of the first and second data lines DL1 and DL2 of the display panel 100*a*, a length of one horizontal period, or the like. The threshold value α may increase, as the operation performance of the channel amplifiers SA increases, the length of the horizontal period increases, and/or the loads of the first and second data lines DL1 and DL2 decreases.

The data comparator 210*a* may compare first pixel data DATA1(*k*) and second pixel data DATA2(*k*) of a $k^{th}$ horizontal line with first pixel data DATA1(*k*+1) and second pixel data DATA2(*k*+1) of a $(k+1)^{th}$ horizontal line, respectively.

In operation S240, if data transition amounts of the first and second pixel data DATA1 and DATA2 are less than the threshold value α based on a comparison result, the data comparator 210*a* may control the first channel amplifier SA1 to be turned on and the second channel amplifier SA2 to be turned off during the $(k+1)^{th}$ horizontal period H(k+1).

In operation S260, if at least one of the data transition amounts of the first and second pixel data DATA1 and DATA2 is equal to or greater than the threshold value α, based on the comparison result, the data comparator 210*a* may control the first and second channel amplifiers SA1 and SA2 to be turned on during the $(k+1)^{th}$ horizontal period H(k+1).

Figure 8:
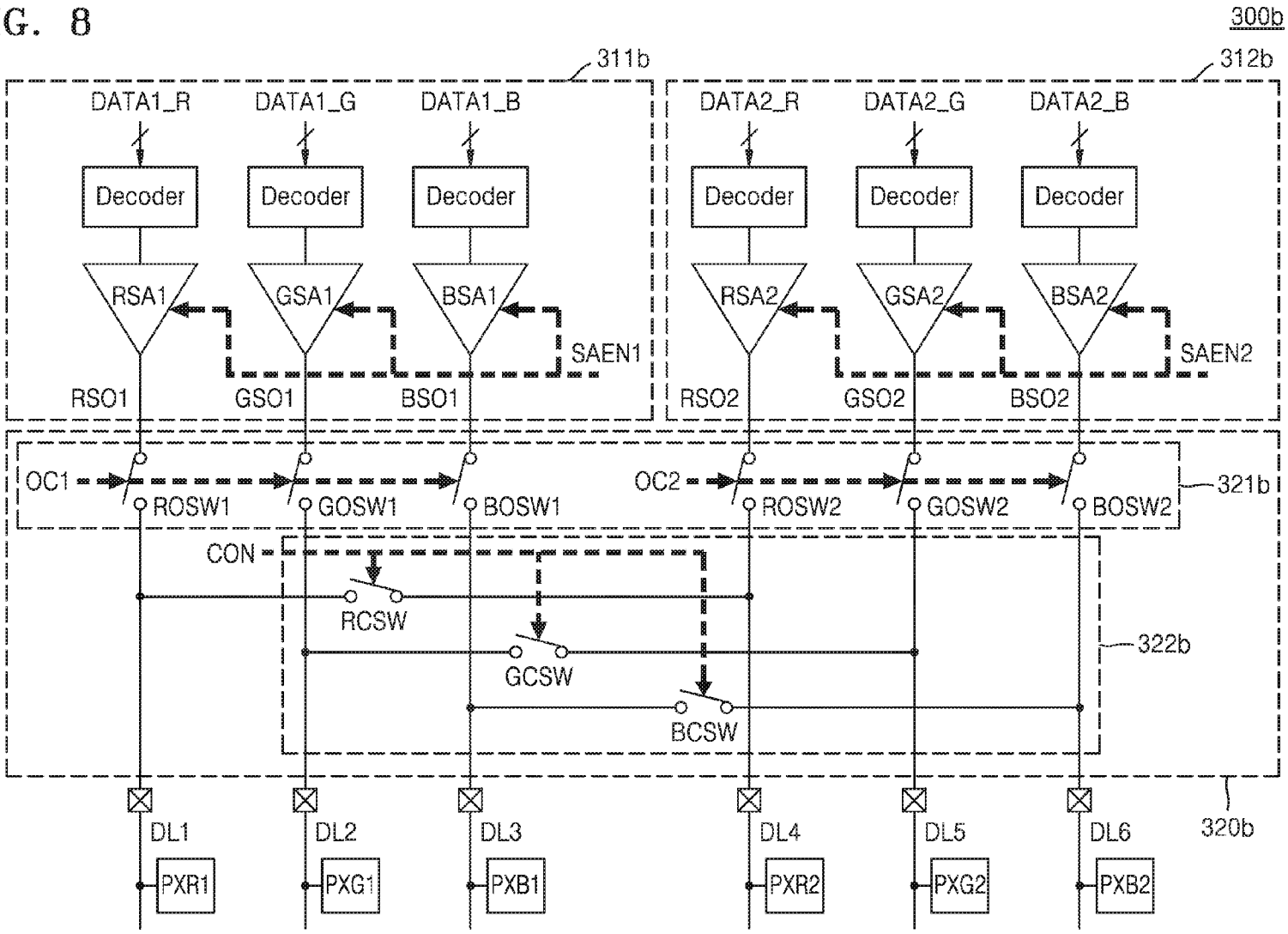
FIG. 8 is a circuit diagram of an example of a data driver according to an example embodiment.

FIG. 8 is a circuit diagram of an example of a data driver 300*b* according to an example embodiment. The data driver 300*b* may provide image signals to a display panel in which first, second, and third sub-pixels PXR, PXG, and PXB emitting different light colors are repeatedly arranged in one horizontal line side by side. In an example embodiment, the display panel is an RGB panel, and sub-pixels, for example, the first and third sub-pixels PXR, PXG and PXB, may respectively emit red (R) light, green (G) light, and blue (B) light. However, example embodiments of the inventive concepts are not limited thereto, and the sub-pixels may emit different light colors. For convenience, it is assumed that the first, second, and third sub-pixels PXR, PXG and PXB are an R sub-pixel PXR, a G sub-pixel PXG, and a B sub-pixel PXB.

Referring to FIG. 8, the data driver 300*b* may include first and second driving units 311*b* and 312*b* and an output controller 320*b*. For convenience, FIG. 8 only shows the first and second driving units 311*b* and 312*b*.

The first driving unit 311*b* may receive first R data DATA1_R, first G data DATA1_G, and first B data DATA1_B and may generate image signals corresponding to the first R data DATA1_R, the first G data DATA1_G, and the first B data DATA1_B, respectively. The first driving unit 311*b* may output the generated image signals through a first R channel amplifier RSA1, a first G channel amplifier GSA1, and a first B channel amplifier BSA1. The first R channel amplifier RSA1, the first G channel amplifier GSA1, and the first B channel amplifier BSA1 may operate in response to the first enable signal SAEN1. For example, when the first enable signal SAEN1 is at the first level, for example, logic high, the first R channel amplifier RSA1, the first G channel amplifier GSA1, and the first B channel amplifier BSA1 may operate. When the first enable signal SAEN1 is at the second level, for example, logic low, the first R channel amplifier RSA1, the first G channel amplifier GSA1, and the first B channel amplifier BSA1 may stop operating.

Operations and a structure of the second driving unit 312*b* are similar to those of the first driving unit 311*b*. The second driving unit 312*b* may include a second R channel amplifier RSA2, a second G channel amplifier GSA2, and a second B channel amplifier BSA2, and the second R channel amplifier RSA2, the second G channel amplifier GSA2, and the second B channel amplifier BSA2 may operate in response to the second enable signal SAEN2.

The output controller 320*b* may include output switches 321*b* and connection switches 322*b*. The output switches 321*b* may include first R, first G, and first B output switches ROSW1, GOSW1, and BOSW1 connected to the first driving unit 311*b* and second R, second G, and second B output switches ROSW2, GOSW2, and BOSW2 connected to the second driving unit 312*b*. The first R, first G, and first B output switches ROSW1, GOSW1, and BOSW1 may be turned on or off in response to the first output control signal OC1, and the second R, second G, and second B output switches ROSW2, GOSW2, and BOSW2 may be turned on or off in response to the second output control signal OC2. The connection switches 322*b* may include an R connection switch RCSW, a G connection switch GCSW, and a B connection switch BCSW. The R connection switch RCSW, the G connection switch GCSW, and the B connection switch BCSW may be turned on or off in response to the connection control signal CON.

The R connection switch RCSW is turned on and may provide an output RSO1 of the first R channel amplifier RSA1 to a fourth data line DL4 connected to a second R sub-pixel PXR2 or an output RSO2 of the second R channel amplifier RSA2 to a first data line DL1 connected to a first R sub-pixel PXR1.

The G connection switch GCSW is turned on and may provide an output GSO1 of the first G channel amplifier GSA1 to a fifth data line DL5 connected to a second G sub-pixel PXG2 or an output GSO2 of the second G channel amplifier GSA2 to a second data line DL2 connected to a first G sub-pixel PXG1.

The B connection switch BCSW is turned on and may provide an output BSO1 of the first B channel amplifier BSA1 to a sixth data line DL6 connected to a second B sub-pixel PXB2 or an output BSO2 of the second B channel amplifier BSA2 to a third data line DL3 connected to a first B sub-pixel PXB1.

The control signals, for example, the first enable signal SAEN1, the second enable signal SAEN2, the first output control signal OC1, the second output control signal OC2, and the connection control signal CON may be provided by a data comparator (e.g., the data comparator 210*a* of FIG. 2). As described with reference to FIG. 2, the data comparator 210*a* may analyze the pixel data and generate the control signals based on the analysis result. The data comparator 210*a* may receive and compare the first and second pixel data DATA1(*k*+1) and DATA2(*k*+1) of the next line during the current horizontal period. The control signals may be generated based on the comparison result. In this case, each of the first pixel data DATA1(*k*+1) and the second pixel data DATA2(*k*+1) includes R data, G data, and B data. In an example embodiment, the data comparator 210*a* may generate the control signals based on the first and second data transition amounts and the comparison result as described with reference to FIG. 2. The operations of the data comparator 210*a* have been described with reference to FIG. 2, and thus repeated descriptions thereof will be omitted.

Figure 9:
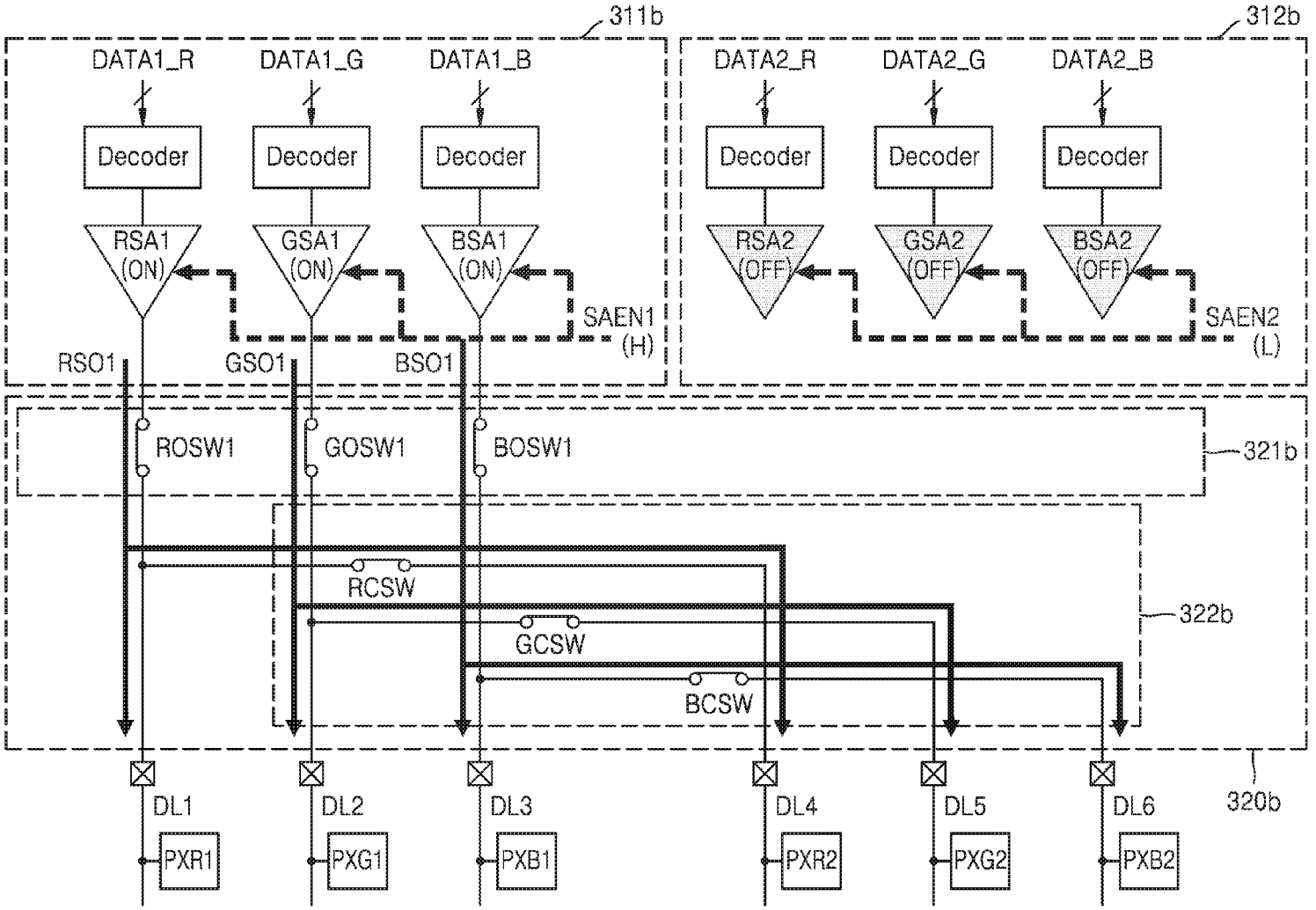
FIG. 9 is a circuit diagram of operations of the data driver of FIG. 8.

FIG. 9 is a circuit diagram showing operations of the data driver 300*b* of FIG. 8. FIG. 9 shows a case where at least one channel amplifier does not operate.

Referring to FIG. 9, based on the first enable signal SAEN1 and the second enable signal SAEN2 output from the data comparator 210*a*, the first R channel amplifier RSA1, the first G channel amplifier GSA1, and the first B channel amplifier BSA1 of the first diving unit 311*b* may be turned on, and the second R channel amplifier RSA2, the second G channel amplifier GSA2, and the second B channel amplifier BSA2 of the second driving unit 312*b* may be turned off. In this case, the first R output switch ROSW1, the first G output switch GOSW1, the first B output switch BOSW1, the R connection switch RCSW, the G connection switch GCW, and the B connection switch BCW are turned on. Thus, the output RSO1 of the first R channel amplifier RSA1 may be provided to the first and the fourth data lines DL1 and DL4, the output GSO1 of the first G channel amplifier GSA1 may be provided to the second and fifth data lines DL2 and DL5, and the output BSO1 of the first B channel amplifier BSA1 may be provided to the third and sixth data lines DL3 and DL6.

Figure 10:
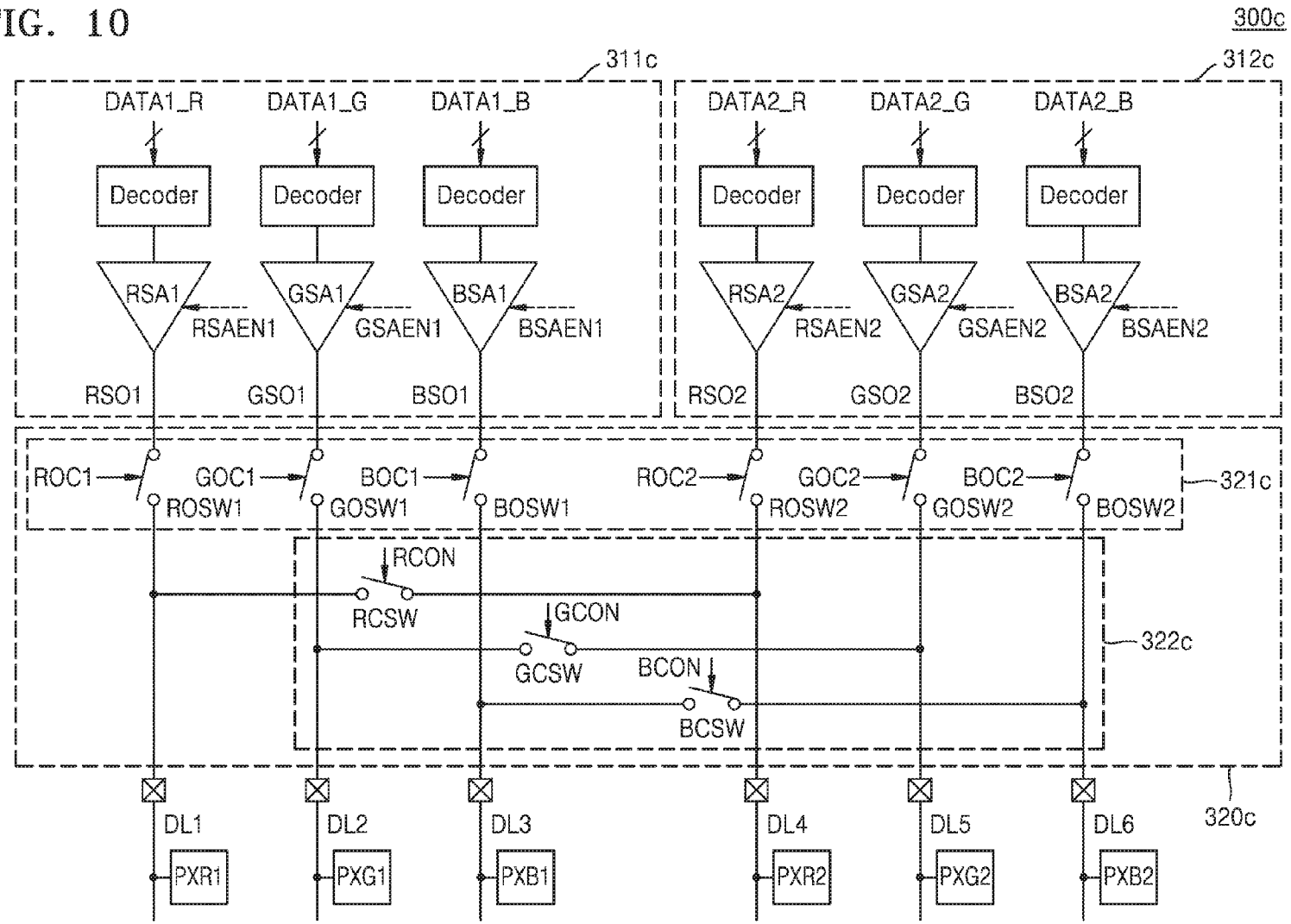
FIG. 10 is a circuit diagram of a data driver according to an example embodiment.
Figure 11:
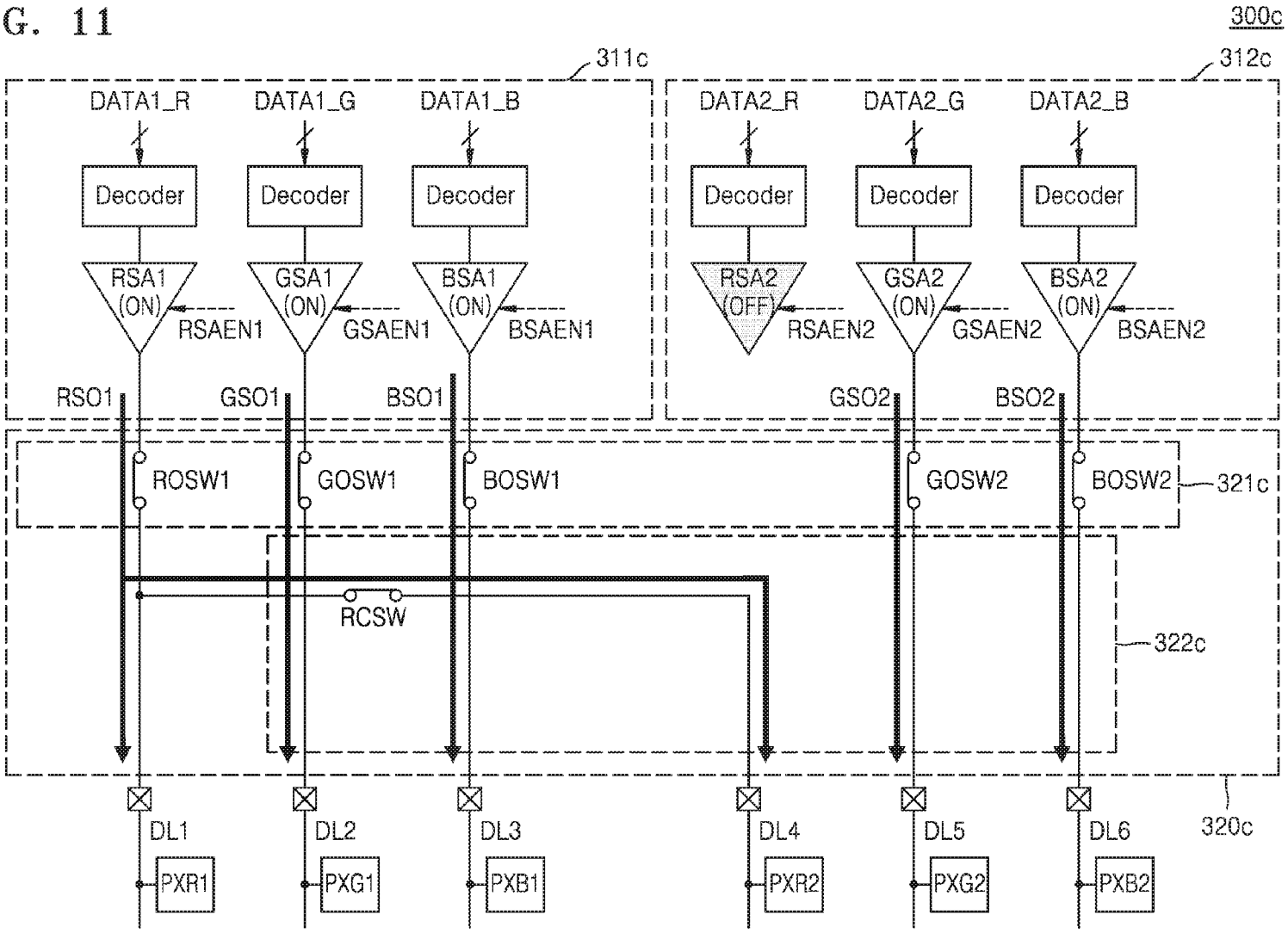
FIG. 11 is a circuit diagram of operations of the data driver of FIG. 10.

FIG. 10 is a circuit diagram of a data driver 300*c* according to an example embodiment, and FIG. 11 is a circuit diagram showing operations of the data driver 300*c* of FIG. 10.

A structure and operations of the data driver 300*c* of FIG. 10 are similar to those of the data driver 300*b* of FIG. 8. In FIG. 8, one driving unit, for example, the first R channel amplifier RSA1, the first G channel amplifier GSA1, and the first B channel amplifier BSA1 of a first diving unit 311*b*, operate in response to the same control signal, for example, the first enable signal SAEN1. However, in FIG. 10, one driving unit, for example, the first R channel amplifier RSA1, the first G channel amplifier GSA1, and the first B channel amplifier BSA1 of the first diving unit 311*c*, may operate in response to different control signals RSAEN1, GSAEN1, and BSAEN1. The first R, first G, and first B output switches ROSW1, GOSW1, and BOSW1 may also operate in response to different control signals ROC1, GOC1, and BOC1, and the R connection switch RCSW, the G connection switch GCW, and the B connection switch BCW may individually operate in response to different control signals RCON, GCON, and BCON.

Accordingly, as shown in FIG. 11, one of the second R channel amplifier RSA2, the second G channel amplifier GSA2, and the second B channel amplifier BSA2 of the second driving unit 312*c*, for example, the second R channel amplifier RSA2, may be turned off, and others thereof, for example, the second G channel amplifier GSA2 and the second B channel amplifier RSA2, may be turned on.

According to the operations of the data driver 300*c* of FIGS. 10 and 11, although the first pixel data DATA1(*k*+1) of the next line is not exactly the same as the second pixel data DATA2(*k*+1) of the next line, if at least one of three pieces of color data included in the first pixel data DATA1(*k*+1) is the same as at least one of three pieces of color data included in the second pixel data DATA2(*k*+1), at least one channel amplifier SA may be turned off. For example, when first R data. DATA1_R of the next line is the same as second R data DATA2_R of the next line, and when data transition amounts of the first R data. DATA1_R and the second R data DATA2_R between the current line and the next line are less than a threshold value, the second R channel amplifier RSA2 may be turned off.

The control signals provided to the data driver 300*c* of FIG. 10 may be provided by the data comparator 210 (of FIG. 1), and the data comparator 210 may compare the first R data DATA1_R, the first G data DATA1_G, and the first B data DATA1_B included in the first pixel data. DATA1(*k*+1) of the next line with the second R data DATA2_R, the second G data DATA2_G, and the second B data DATA2_B included in the second pixel data DATA2(*k*+1), respectively, and may generate the control signals based on comparison results.

It has been described with reference to FIGS. 8 to 11 that the display panel is an RGB display panel including the first, second, and third sub-pixels PXR, PXG, and PXB which respectively emit R, G, and B light. However, the inventive concepts are not limited thereto. The present example embodiment may be applied to a data driver for providing image signals to various types of display panels such as a pentile panel.

Figure 12:
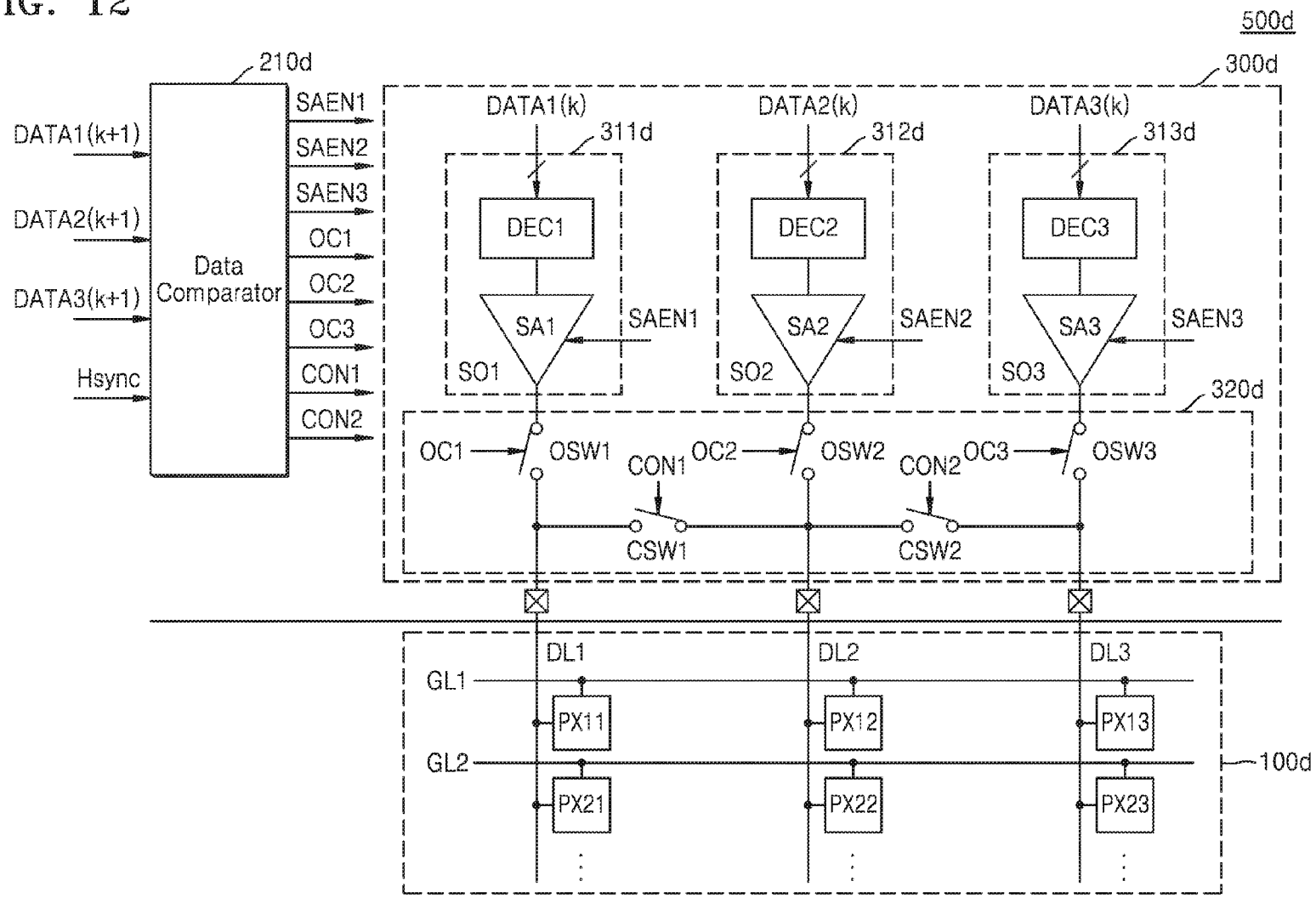
FIG. 12 is a circuit diagram of a display driving circuit according to an example embodiment.
Figure 13A:
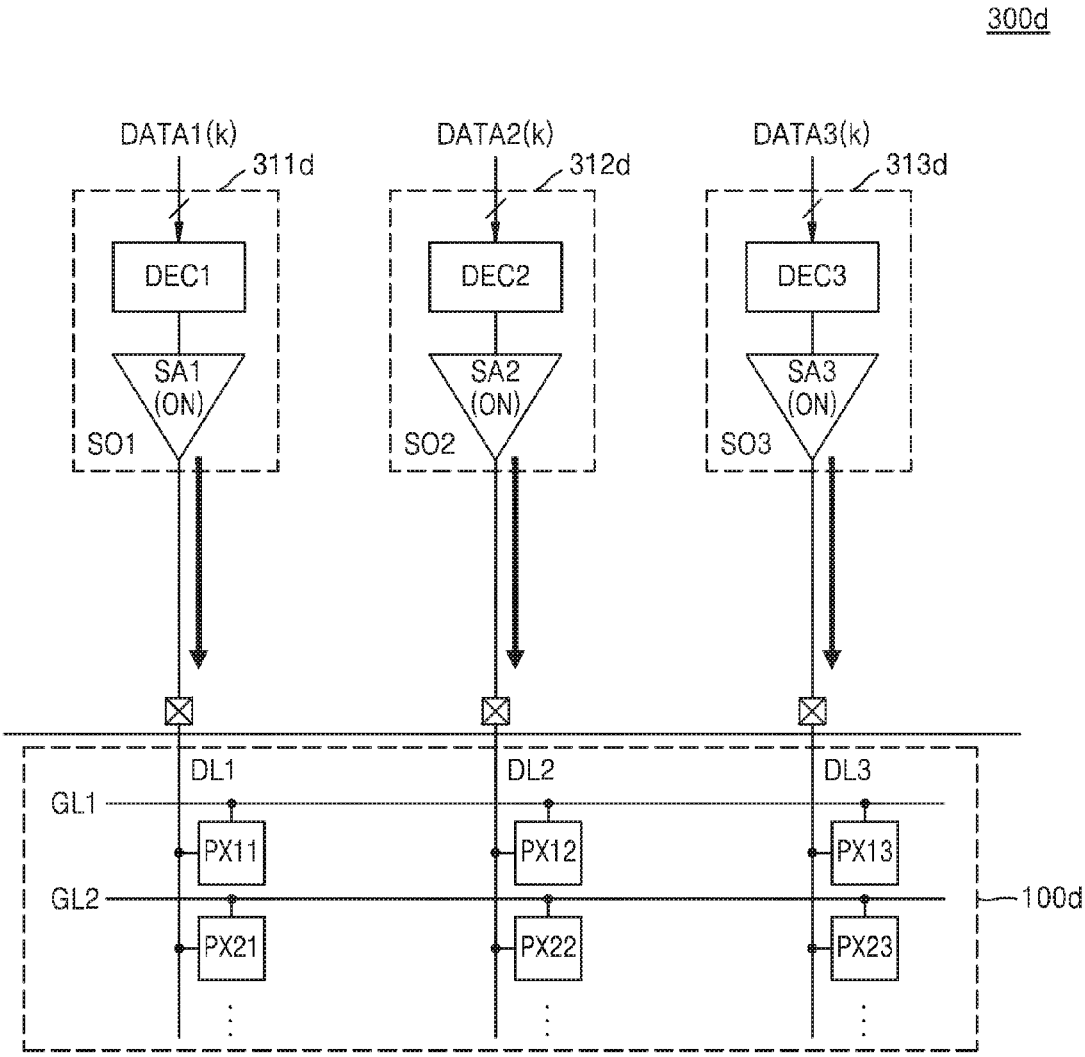
FIGS. 13A to 13C are circuit diagrams of operations of a data driver of FIG. 12.
Figure 13B:
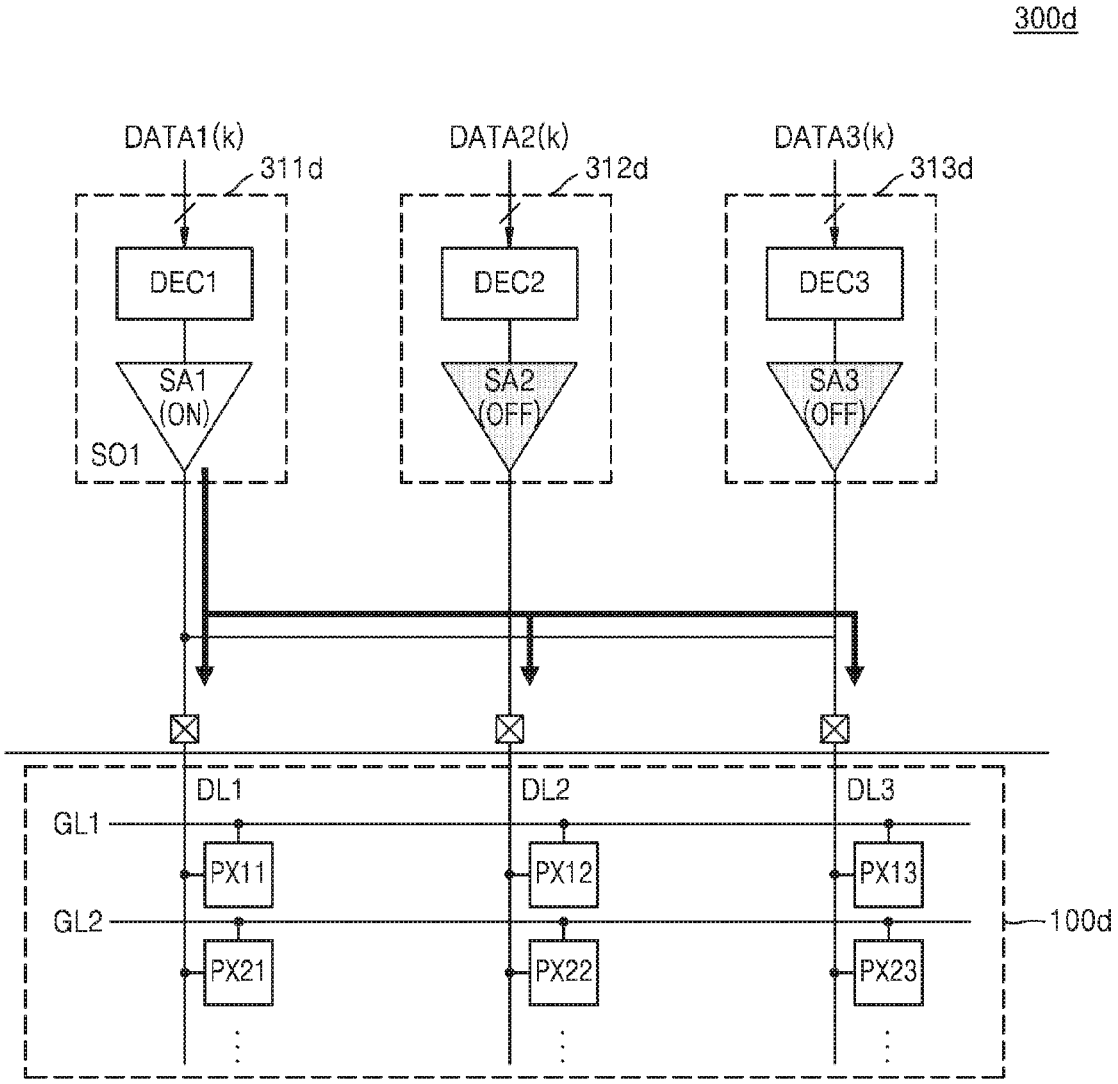
Figure 13C:
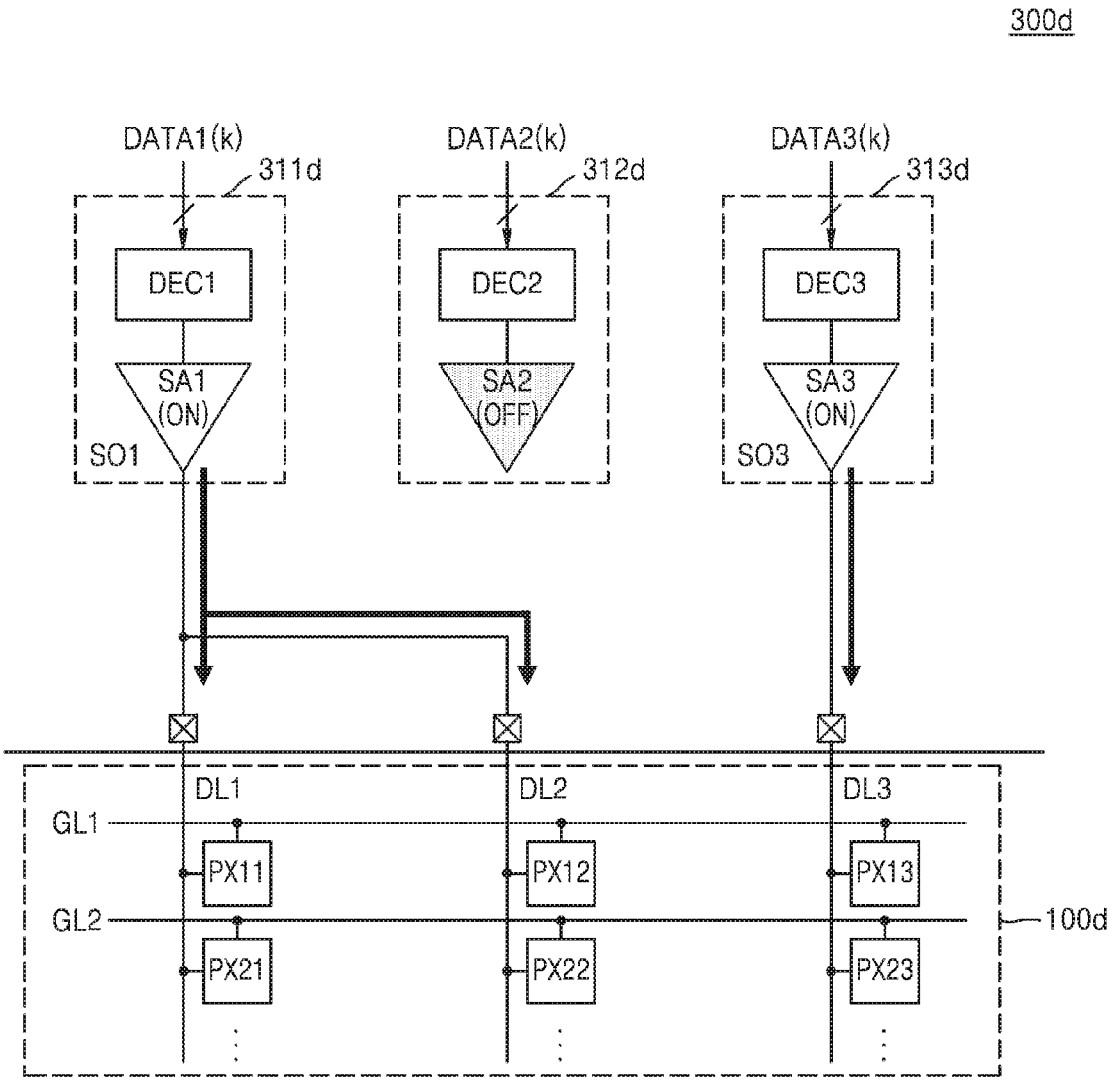

FIG. 12 is a circuit diagram of a display driving circuit 500*d* according to an example embodiment. FIGS. 13A to 13C are circuit diagrams showing operations of a data driver 300*d* of FIG. 12.

Referring to FIG. 12, the display driving circuit 500*d* may include a data comparator 210*d* and the data driver 300*d*. The display driving circuit 500*d* may further include components other than the components shown in FIG. 1.

The data comparator 210*d* may analyze pixel data DATA1, DATA2, and DATA3 and may generate control signals for controlling the data driver 300*d* based on analysis results. For example, the control signals may include a first enable signal SAEN1, a second enable signal SAEN2, a third enable signal SAEN3, a first output control signal OC1, a second output control signal OC2, a third output control signal OC3, a first connection control signal CON1, and a second connection control signal CON2.

The data comparator 210*d* may receive first, second, and third pixel data DATA1(*k*+1), DATA2(*k*+1), and DATA3(*k*+1) of the next line and may compare the first, second, and third pixel data DATA1(*k*+1), DATA2(*k*+1), and DATA3(*k*+1) with each other during a current horizontal period. The data comparator 210*d* may generate the control signals based on comparison results of comparing the first, second, and third pixel data DATA1(*k*+1), DATA2(*k*+1), and DATA3(*k*+1).

The data driver 300*d* may include driving units 311*d* to 313*d* and an output controller 320*d*. The output controller 320*d* may include first to third output switches OSW1 to OSW3 and may include first and second connection switches CSW1 and CSW2.

The first to third output switches OSW1 to OSW3 may be turned on or off in response to first to third output control signals OCC to OC3, respectively. As shown in FIG. 13A, the first to third output switches OSW1 to OSW3 are turned on and may provide outputs SO1 to SO3 of the first to third channel amplifiers SA1 to SA3 to the first to third data lines DL1 to DL3, respectively.

The first and second connection switches CSW1 and CSW2 may be turned on or off in response to the first and second connection control signals CON1 and CON2. According to operations of the first and second connection switches CSW1 and CSW2, transmission paths via which the outputs SO1 to SO3 of the first to third channel amplifiers SA1 to SA3 are transmitted may be changed.

In the present example embodiment, if it is determined that at least two of the first, second, and third pixel data DATA1(*k*+1), DATA2(*k*+1), and DATA3(*k*+1) of the next line are the same, the data comparator 210*d* may control one of at least two channel amplifiers SA connected to the at least two pieces of pixel data to be turned off at a point in time when or before the next horizontal period starts.

Referring to FIG. 13A, when the first, second, and third pixel data DATA1(*k*+1), DATA2(*k*+1), and DATA3(*k*+1) of the next line are different from each other, the data driver 300*d* may turn on all of the first to third channel amplifiers SA1 to SA3 and may provide the outputs SO1 to SO3 of the first to third channel amplifiers SA1 to SA3 to their corresponding data lines, that is, the first to third data lines DL1 to DL3, during the next horizontal period.

Referring to FIG. 13B, when the first, second, and third pixel data DATA1(*k*+1), DATA2(*k*+1), and DATA3(*k*+1) of the next line are same as each other, the data comparator 210*d* may control the data driver 300*d* in such a manner that one of the first to third channel amplifiers SA1 to SA3 is turned on and others thereof are turned off during the next horizontal period. For example, the first channel amplifier SA1 may be turned on, and the second and third channel amplifiers SA2 and SA3 may be turned off. In this case, the output SO1 of the first channel amplifier SA1 may be provided to the first to third data lines DL1 to DL3. In other words, the first channel amplifier SA1 may drive three pixels connected to different data lines.

Referring to FIG. 13C, the first pixel data DATA1(*k*+1) of the next line may be the same as the second pixel data. DATA2(*k*+1) of the next line, and the third pixel data DATA3(*k*+1) may be different from the first pixel data DATA1(*k*+1) and the second pixel data DATA2(*k*+1). The data comparator 210*d* may control the data driver 300*d* in such a manner that one of the first and second channel amplifiers SA1 and SA2 is turned on, the other thereof is turned off, and the third channel amplifier SA3 is turned on during the next horizontal period. For example, the first channel amplifier SA1 may be turned on, and the second channel amplifier SA2 may be turned off. In this case, the output SO1 of the first channel amplifier SA1 may be provided to the first and second data lines DL1 and DL2. The third channel amplifier SA3 may independently operate.

Referring back to FIG. 12, in an example embodiment, when at least two of the first, second, and third pixel data DATA1(*k*+1), DATA2(*k*+1), and DATA3(*k*+1) of the next line are the same, and when data transition amounts of the at least two of the first, second, and third pixel data DATA1 (*k*+1), DATA2(*k*+1), and DATA3(*k*+1) are less than the threshold value that is set in advance, the data comparator 210*d* may control one of at least two channel amplifiers SA corresponding to at least two pixels to be turned off at a time when or before the next horizontal period starts.

In this case, the threshold value may differ according to how many pieces of the first, second, and third pixel data DATA1(*k*+1), DATA2(*k*+1), and DATA3(*k*+1) of the next line are the same. For example, when two pieces of pixel data are the same as each other and the data transition amount of each piece of pixel data is less than a first threshold value, the data comparator 210*d* may control one channel amplifier SA to be turned off during the next horizontal period. When three pieces of the pixel data are the same as one another, in other words, the first, second, and third pixel data DATA1(*k*+1), DATA2(*k*+1), and DATA3(*k*+1) of the next line are the same, and when the data transition amount of each of the first, second, and third pixel data DATA1(*k*+1), DATA2(*k*+1), and DATA3(*k*+1) is less than a second threshold value, the data comparator 210*d* may control two channel amplifiers SA to be turned off and one channel amplifier SA to drive three pixels during the next horizontal period. In an example embodiment, the first threshold value may be greater than the second threshold value. In other words, as the number of pixels that one channel amplifier needs to drive is great, the threshold value may be small.

In the present example embodiment, the data comparator 210*d* may compare three pieces of pixel data of the next line and may determine how many pixels one channel amplifier drives according to a comparison result. However, the inventive concepts are not limited thereto. The data comparator 210*d* may compare at least four pieces of pixel data of the next line.

Figure 14:
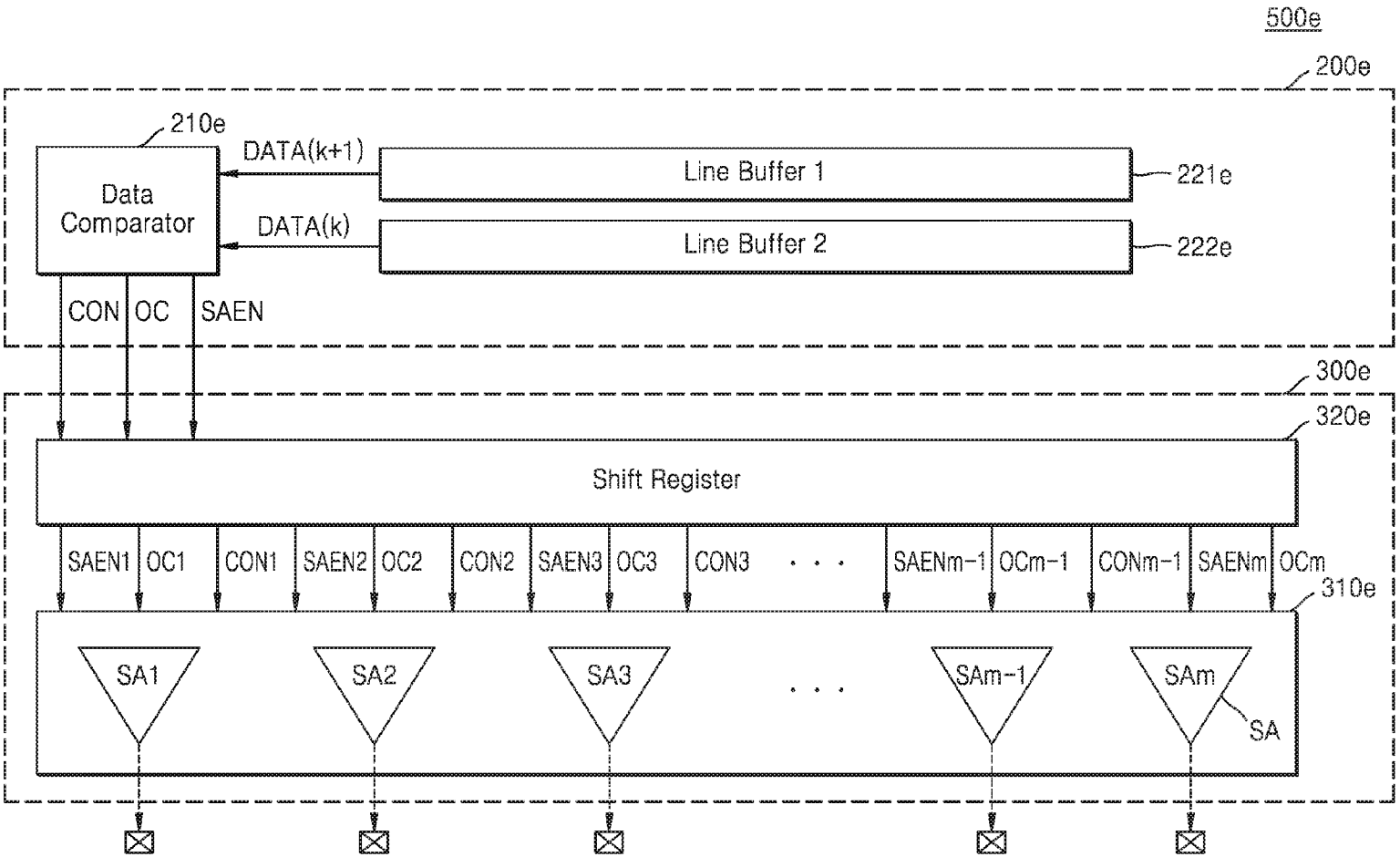
FIG. 14 is a block diagram of a display driving circuit according to an example embodiment.

FIG. 14 is a block diagram of a display driving circuit 500*e* according to an example embodiment. FIG. 14 shows the timing controller 200 and the data driver 300 of the display device 1000 of FIG. 1 in detail, and the descriptions provided with reference to FIG. 1 may be applied to the present example embodiment.

Referring to FIG. 14, the display driving circuit 500*e* may include a timing controller 200*e* and a data driver 300*e*. The display driving circuit 500*e* may further include components other than the components shown in FIG. 1.

The timing controller 200*e* may include a data comparator 210*e* and first and second line buffers 221*e* and 222*e*.

The first and second line buffers 221*e* and 222*e* may store pixel data of one horizontal line. The first line buffer 221*e* may store and output pixel data DATA(k+1) of a next line. The second line buffer 222*e* may store and output pixel data DATA(k) of a current line. When the display driving circuit 500*e* includes a graphic memory that stores image data of one frame, the graphic memory may substitute the first and second line buffers 221*e* and 222*e*.

The data comparator 210*e* may receive the pixel data DATA(k+1) of the next line, which is output from the first line buffer 221*e*, and may compare adjacent pieces of pixel data with each other. For example, pieces of pixel data of one horizontal line are sequentially output from the first line buffer 221*e*, and the data comparator 210*e* may sequentially receive the output pieces of pixel data. The data comparator 210*e* may compare the pieces of pixel data which are sequentially received with each other.

Also, the data comparator 210*e* may receive the pixel data DATA(k+1) of the next line, which is output from the first line buffer 221*e*, and the pixel data DATA(k) of the current line, which is output from the second line buffer 222*e*, and may determine data transition amounts of the pixel data of the current line and the next line by comparing the pixel data DATA(k+1) of the next line with the pixel data DATA(k) of the current line. The data comparator 210*e* may receive and calculate the pixel data. DATA(k) of the next line and the pixel data DATA(k) of the current line and may generate control signals CON, OC, and SAEN based on a calculation result. For example, the control signals CON, OC, and SAEN may include an enable signal SAEN, an output control signal OC, and a connection control signal CON. The enable signal SAEN and the output control signal OC may respectively include enable signals SAEN1 to SAENm and output control signals OC1 to OCm which correspond to the first to in $m^{th}$ channel amplifiers SA1 to SAm included in a driving unit 310*e* of a data driver 300*e*. The connection control signal CON may include connection control signals CON1 to CONm−1 for controlling a transmission path via which outputs of the first to $m^{th}$ channel amplifiers SA1 to SAm are transmitted.

The data comparator 210*e* may receive the first pixel data DATA1(*k*+1) and the second pixel data DATA2(*k*+1) of the next line from the first line buffer 221*e*, receive the first pixel data DATA1(*k*) and the second pixel data DATA2(*k*) of the current line from the second line buffer 222*e*, and generate the first and second enable signals SAEN1 and SAEN2, the first and second output control signals OC1 and OC2, and the first connection control signal CON1 based on results of calculating the received first pixel data DATA1($k$+1) and second pixel data DATA2($k$+1) and the received first pixel data DATA1($k$) and second pixel data DATA2($k$). Then, the data comparator 210$e$ may receive third pixel data DATA3 ($k$+1) of the next line from the first line buffer 221$e$, receive third pixel data DATA3($k$) of the current line from the second line buffer 222$e$, calculate the received second and third pixel data DATA2($k$+1) and DATA3($k$+1) of the next line, and generate a third enable signal SAEN3, a third output control signal OC3, and a second connection control signal CON2 based on a calculation result. The data comparator 210$e$ may sequentially generate and output the control signals.

The data driver 300$e$ may include a shift register 320$e$ and a driving unit 310$e$.

The shift register 320$e$ may store and shift control signals SAEN1 to SAENm, OC1 to OCm, and CON1 to CONm−1 that are sequentially transmitted from the data comparator 210$e$, and the control signals SAEN1 to SAENm, OC1 to OCm, and CON1 to CONm−1 may be stored. The shift register 320$e$ may provide the data driver 310$e$ with the control signals SAEN1 to SAENm, OC1 to OCm, and CON1 to CONm−1. Also, although not shown in FIG. 14, the shift register 320$e$ may store and shift pixel data. DATA(k) of the current line, which is output from a second line buffer 222$e$, and may provide the pixel data DATA(k) of one line, which is stored, to the driving unit 310$e$.

The driving unit 310$e$ may output image signals according to the pixel data DATA(k) of the current line in response to the control signals SAEN1 to SAENm, OC1 to OCm, and CON1 to CONm−1. The driving unit 310$e$ may include first to $m^{th}$ channel amplifiers SA1 to SAm, and transmission paths via which operation states and outputs of the first to $m^{th}$ channel amplifiers SA1 to SAm are transmitted may be changed in response to the control signals SAEN1 to SAENm, OC1 to OCm, and CON1 to CONm−1. The structures and operations of the data drivers 310$a$, 310$b$, 310$c$, 310$d$, and 310$e$ according to the example embodiments described with reference to FIGS. 1 to 13C may be applied to the driving unit 310$e$.

When the data comparator 210$e$ provides the control signals SAEN1 to SAENm, OC1 to OCm, and CON1 to CONm−1 to the driving unit 310$e$ through separate signal lines, it is necessary to prepare signal lines corresponding to the number of control signals SAEN1 to SAENm, OC1 to OCm, and CON1 to CONm−1. When the data comparator 210$e$ and the driving unit 310$e$ are embodied as different semiconductor chips, it is necessary to prepare connection pads and connection lines of semiconductor chips, which correspond to the number of signal lines. Also, when the data comparator 210$e$ and the driving unit 310$e$ are embodied as the same semiconductor chip, a length of a layout of the data comparator 210$e$ in a first direction (e.g., a length of a layout in a long axis) is relatively much shorter than a length of a layout of the driving unit 310$e$ in the first direction. Since signal lines between the data comparator 210$e$ and the driving unit 310$e$ need to be routed, an area of the display driving circuit 500$e$ may increase.

However, according to the present example embodiment, the data comparator 210$e$ may sequentially generate the control signals SAEN1 to SAENm, OC1 to OCm, and CON1 to CONm−1, provide the shift register 320$e$ with the generated control signals SAEN1 to SAENm, OC1 to OCm, and CON1 to CONm−1, and provide the control signals SAEN1 to SAENm, OC1 to OCm, and CON1 to CONm−1 to the driving unit 310$e$ through the shift register 320$e$. The data comparator 210$e$ may provide the control signals SAEN1 to SAENm, OC1 to OCm, and CON1 to CONm−1 to the shift register 320$e$ through signal lines, of which the number is relatively much less than the number of control signals SAEN1 to SAENm, OC1 to OCm, and CON1 to CONm−1. A routing area of the signal lines is small, and since a length of a layout of the shift register 320$e$ in the first direction is similar to the length of the driving unit 310$e$ in the first direction, a routing area of the signal lines between the shift register 320$e$ and the driving unit 310$e$ may be greatly small. Therefore, the area of the display driving circuit 500$e$ may decrease.

Figure 15:
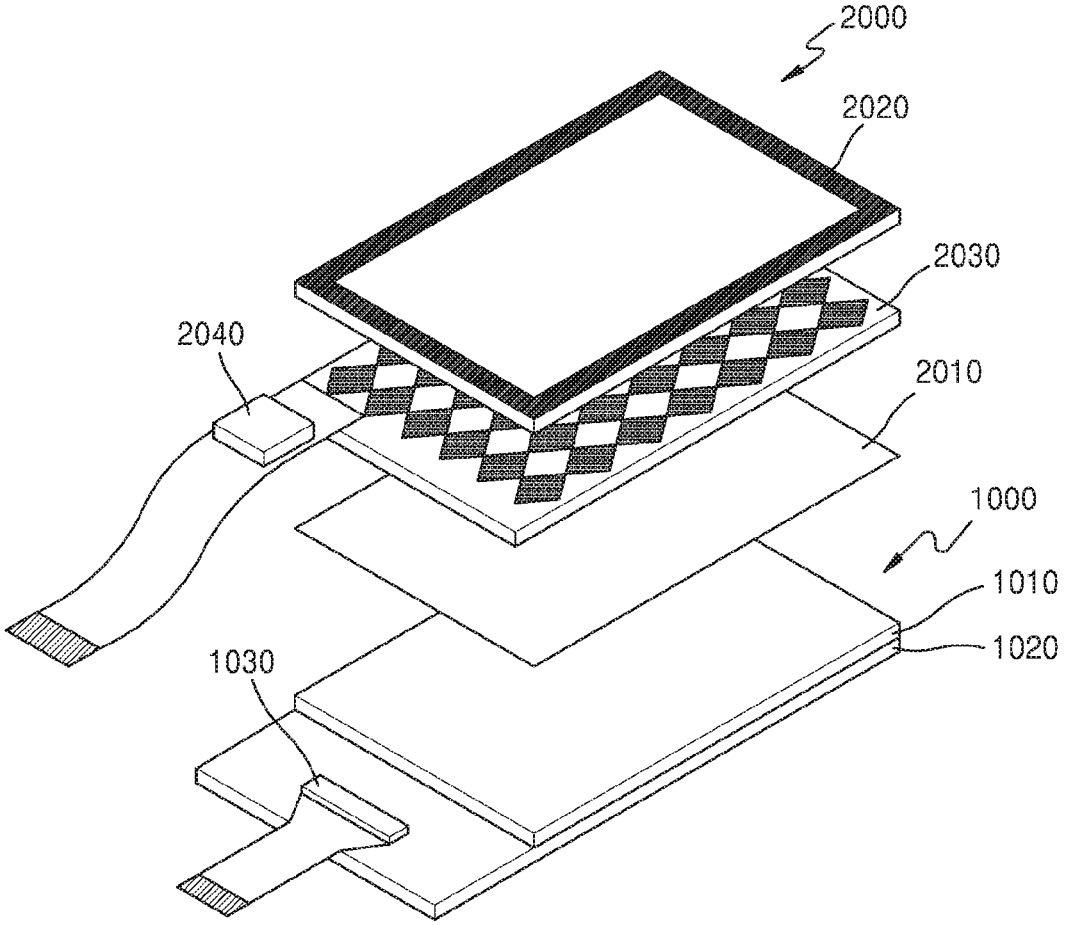
FIG. 15 shows a touch screen module according to an example embodiment.

FIG. 15 shows a touch screen module 2000 according to an example embodiment.

Referring to FIG. 15, the touch screen module 2000 may include the display device 1000, a polarizer 2010, a touch panel 2030, a touch controller 2040, and window glass 2020. The display device 1000 may include a display panel 1010, a printed circuit board 1020, and a display driving circuit 1030. The display device 1000 may be the display device 1000 according to example embodiments described with reference to FIGS. 1 to 14.

The window glass 2020 may include a material such as acryl or tempered glass and protects the touch screen module 2000 from scratches due to external impact or repetitive touches. The polarizer 2010 may be included in the touch screen module 2000 to improve optical characteristics of the display panel 1010. The display panel 1010 may be formed by patterning a transparent electrode on the printed circuit board 1020. The display panel 1010 may include pixels for displaying a frame. According to an example embodiment, the display panel 1010 may be a liquid crystal display (LCD). However, the inventive concepts are not limited thereto, and the display panel 1010 may include various types of display devices. For example, the display panel 1010 may be one of an Organic Light Emitting Diode (OLED) display, an Electrochromic Display (ECD), a Digital Mirror Device (DMD), an Actuated Mirror Device (AMD), a Grating Light Valve (GLV), a Plasma Display Panel (PDP), an Electro Luminescent Display (ELD), a Light Emitting Diode (LED) display, and a Vacuum Fluorescent Display (VFD).

The display driving circuit 1030 may include the display driving circuits 500$a$, 500$d$, and 500$e$ according to example embodiments. The display driving circuit 1030 may reduce a static current of a data driver by turning off some of channel amplifiers based on pixel data. Also, the display driving circuit 1030 may reduce power consumption and may prevent quality deterioration of an image displayed on the display panel 1010 by determining in advance operation states of the channel amplifiers during a next horizontal period, turning on the channel amplifiers before the next horizontal period starts, and securing a stabilization time for the channel amplifiers.

In the present example embodiment, the display driving circuit 1030 is shown as one chip for convenience, but there may be a plurality of display driving circuits. Also, the display driving circuit 1030 may be mounted on a glass printed board in a chip on glass (COG) form. However, the inventive concepts are not limited thereto, and the display driving circuit 1030 may be mounted in various forms such as a chip on film (COF) form or a chip on board (COB) form.

The touch screen module 2000 may further include the touch panel 2030 and the touch controller 2040. The touch panel 2030 may be formed by patterning a transparent electrode including Indium Tin Oxide (ITO) on a glass substrate or a Polyethylene Terephthalate (PET) film. In an example embodiment, the touch panel 2030 may be formed on the display panel 1010. For example, pixels of the touch panel 2030 may be combined with pixels of the display panel 1010. The touch controller 2040 calculates coordinates of touches generated and detected on the touch panel 2030 and transmits the calculated coordinates to a host (not shown). The touch controller 2040 and the display driving circuit 1030 may be integrated into one semiconductor chip.

Figure 16:
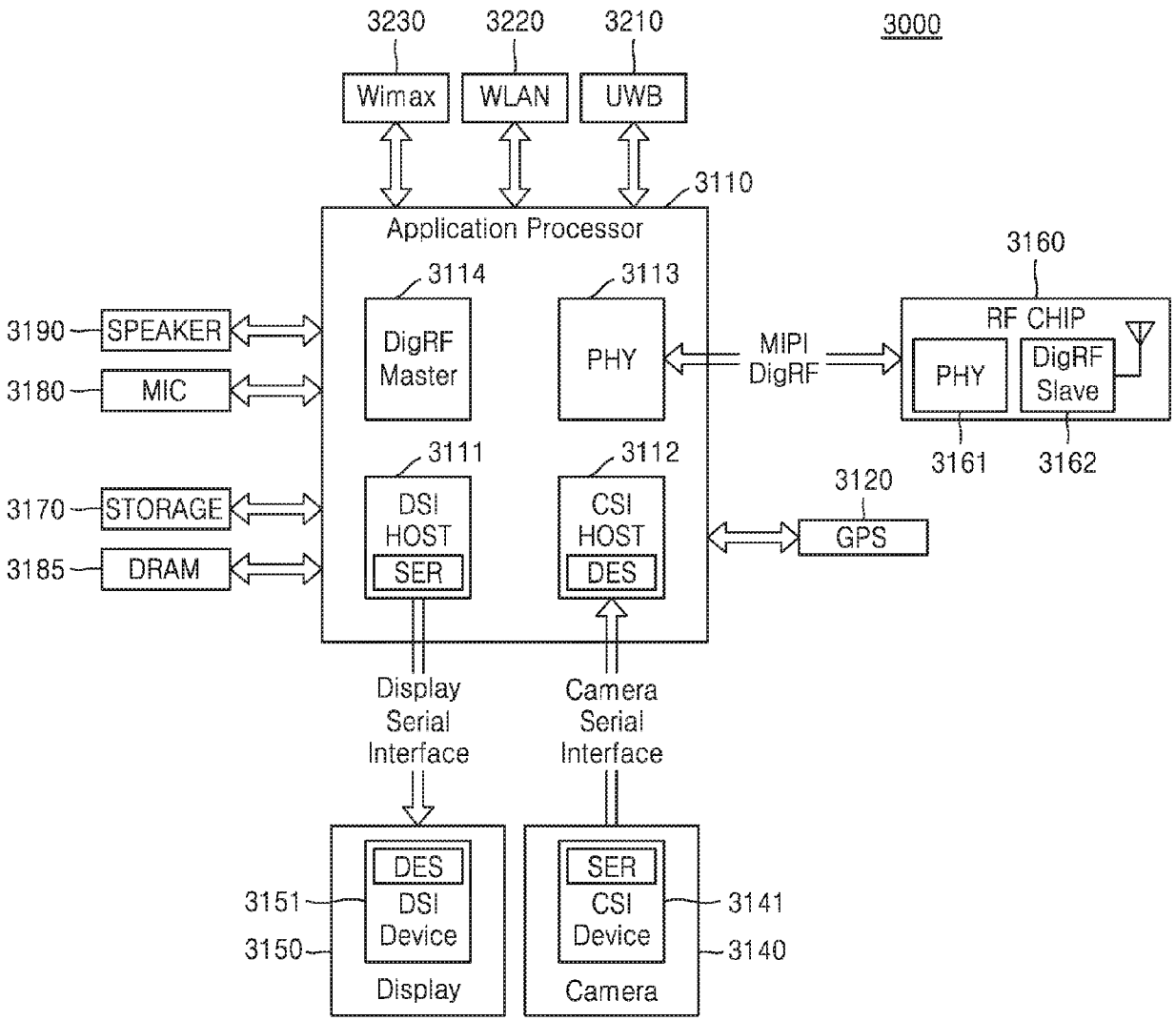
FIG. 16 is a block diagram of an electronic system including a display device according to an example embodiment.

FIG. 16 is a block diagram of an electronic system 3000 including a display device according to an example embodiment.

Referring to FIG. 16, the electronic system 3000 may be embodied as a data processor, for example, a mobile phone, a personal digital assistant (RDA), a portable multimedia player (PMP), or a smart phone, which may use or support a mobile industry processor interface (MIN).

The electronic system 3000 may include an application processor 3110, an image sensor 3140 (for example, a camera), and a display 3150. The display 3150 may be a display device 1000 according to the above-described embodiment. The display 3150 may reduce a static current of a data driver by turning off some of channel amplifiers based on pixel data. Also, the display 3150 may reduce power consumption and prevent quality deterioration of an image displayed on a display panel by determining in advance operation states of the channel amplifiers during a next horizontal period, turning on the channel amplifiers before the next horizontal period starts, and securing a stabilization time of the channel amplifiers.

A camera serial interface (CSI) host 3112 of the application processor 3110 may perform serial communication with a CSI device 3141 of the image sensor 3140 via a CSI. In this case, the CSI host 3112 may include, for example, an optical de-serializer, and the CSI device 3141 may include, for example, an optical serializer.

A display serial interface (DSI) host 3111 of the application processor 3110 may perform serial communication with a DSI device 3151 of the display 3150 via a DSI. In this case, the DSI host 3111 may include an optical serializer, and the DSI device 3151 may include an optical de-serializer.

The electronic system 3000 may further include a radio frequency (RF) chip 3160 that may communicate with the application processor 3110. A PHY 3113 of the application processor 3110 and a PHY 3161 of the RF chip 3160 may exchange data with each other according to a MIPI DigRF.

The electronic system 3000 may further include a global positioning system (GPS) 3120, a storage 3170, a microphone 3180, DRAM 3185, and a speaker 3190 and may communicate therewith via World interoperability for microwave access (Wimax) 3230, a wireless local area network (WLASN) 3220, an ultra wide band (UWB) 3210, etc.

Figure 17:
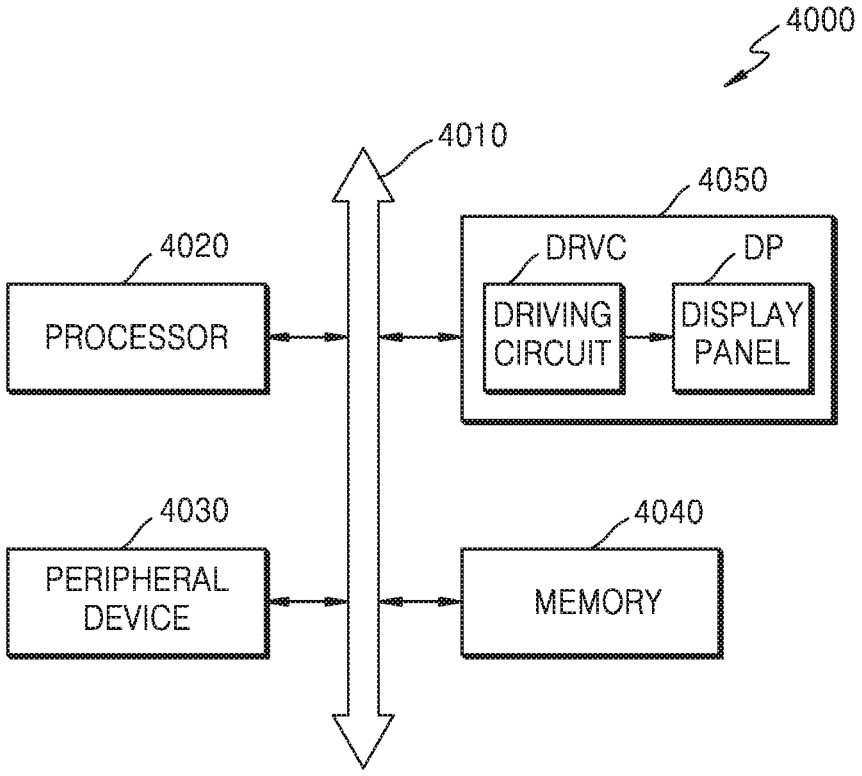
FIG. 17 is a block diagram of a display system according to an example embodiment.

FIG. 17 is a block diagram of a display system 4000 according to an example embodiment.

Referring to FIG. 17, the display system 4000 may include a processor 4020, a display device 4050, a peripheral device 4030, and a memory 4040, which are electrically connected to a system bus 4010.

The processor 4020 may control inputs/outputs of data of the peripheral device 4030, the memory 4040, and the display device 4050 and may perform image processing on image data exchanged among the peripheral device 4030, the memory 4040, and the display device 4050.

The display device 4050 may include a display panel DP and a display driving circuit DRVC and stores image data transmitted through the system bus 4010 in a frame memory or a line memory within the display driving circuit DRVC and then displays the image data on the display panel DP. The display device 4050 may be the display device 1000 according to an example embodiment of the inventive concepts, and the display driving circuit DRVC may include the data driver 300 (of FIG. 1) or the timing controller 200 (of FIG. 1). The display driving circuit DRVC may further include the gate driver 400 (of FIG. 1). The timing controller 200 may reduce the static current of the data driver 300 by turning off some of the channel amplifiers of the data driver 400 based on the pixel data. Also, the timing controller 200 may reduce power consumed by the display device 4050 and may prevent quality deterioration of an image displayed on the display panel DP by determining in advance operation states of the channel amplifiers during the next horizontal period, turning on the channel amplifiers before the next horizontal period starts, and securing a stabilization time for the channel amplifiers.

The peripheral device 4030 may be a device such as a camera, a scanner, or a webcam which is used to convert a moving image, a still image, or the like into electrical signals. Image data obtained via the peripheral device 4030 may be stored in the memory 4040 or may be displayed on the display panel DP of the display device 4050 in real time. The memory 4040 may include a volatile memory device such as dynamic random access memory (DRAM) and/or a non-volatile memory device such as a flash memory. The memory 4040 may include DRAM, phase-change RAM (PRAM), magnetic RAM (MIRAM), resistive (ReRAM), ferroelectric RAM (FRAM), a NOR flash memory, a NAND flash memory, fusion flash memory (e.g., a memory in which an SRAM buffer, a NAND flash memory, and a NOR interface logic are combined), etc. The memory 4040 may store the image data obtained from the peripheral device 4030 or image signals processed by the processor 4020.

The display system 4000 according to the present example embodiment may be included in an electronic device such as a tablet PC or a TV. However, the inventive concepts are not limited thereto. The display system 4000 may be included in various types of electronic devices which display images.

While the inventive concepts have been particularly shown and described with reference to some example embodiments thereof, it will be understood that various changes in form and details may be made therein without departing from the spirit and scope of the following claims.

What is claimed is:

1. A display driving circuit comprising:

a data driver including, a first channel amplifier configured to drive a first data line connected to a first group of pixels of a display panel, the first group of pixels includes a first pixel associated with a first gate line of the display panel, and a second channel amplifier configured to drive a second data line connected to a second group of pixels of the display panel, the second group of pixels includes a second pixel associated with the first gate line; and a data comparator configured to compare first pixel data corresponding to the first pixel with second pixel data corresponding to the second pixel, and configured to determine, before a first horizontal period in which the first pixel and the second pixel are driven, operation states of the first channel amplifier and the second channel amplifier based on a comparison result, wherein the first group of pixels further includes a third pixel associated with a second gate line of the display panel and the second group of pixels further includes a fourth pixel associated with the second gate line, and the data comparator is configured to, during the first horizontal period, compare a third pixel data corresponding to the third pixel and fourth pixel data corresponding to the fourth pixel, compare the first pixel data and the third pixel data, and compare the second pixel data and the fourth pixel data, and is configured to determine the operation states of the first channel amplifier and the second channel amplifier for a second horizontal period in which the third pixel and the fourth pixel are driven based on comparison results, before the second horizontal period.

2. The display driving circuit of claim 1, wherein, the data comparator is configured to determine whether to turn off or turn on the second channel amplifier based on the comparison result and provide a enable signal or disable signal to second channel amplifier, and the first channel amplifier is configured to drive the first pixel and the second pixel, if the second channel amplifier is turned off.

3. The display driving circuit of claim 1, wherein, the second channel amplifier is turned on before the first horizontal period, if the second channel amplifier is turned off before the first horizontal period and the second channel amplifier is determined to be turned on during the first horizontal period.

4. The display driving circuit of claim 3, wherein the data comparator is configured to turn on the second channel amplifier by proving a enable signal to the second channel amplifier at least a time period before the first horizontal period begins, the time period being set based on a stabilization time of the second channel amplifier.

5. The display driving circuit of claim 1, wherein the data comparator is configured to determine that the first channel amplifier is turned on and the second channel amplifier is turned off during the first horizontal period, if the first pixel data and the second pixel data are identical to each other.

6. The display driving circuit of claim 1, wherein the data comparator is configured to determine that the first channel amplifier is turned on and the second channel amplifier is turned off during the second horizontal period, if the third pixel data and the fourth pixel data are identical to each other, and a first data difference of the first pixel data and the third pixel data and a second data difference of the second pixel data and the fourth pixel data are respectively less than a threshold value.

7. The display driving circuit of claim 6, wherein the data driver further comprises:

a third channel amplifier configured to drive a third data line connected to a third group of pixels of the display panel, the third group of pixels includes a fifth pixel associated with the first gate line and a sixth pixel associated with the second gate line, wherein the data comparator is configured to further compare the third pixel data, the fourth pixel data and a sixth pixel data corresponding to the sixth pixel and to compare a fifth pixel data corresponding to the fifth pixel and the sixth pixel data, and configured to determine operation states of the first channel amplifier, the second channel amplifier and the third channel amplifier for the second horizontal period based on comparison results before the second horizontal period.

8. The display driving circuit of claim 7, wherein the data comparator is configured to determine that the first channel amplifier and the third channel amplifier are turned on and the second channel amplifier is turned off during the second horizontal period, if the third pixel data and the fourth pixel data are identical to each other, the fourth pixel data is different from the sixth pixel data, and the first data difference and the second data difference are respectively less than a first threshold value.

9. The display driving circuit of claim 8, wherein the data comparator is configured to determine that the first channel amplifier is turned on, and the second channel amplifier and the third channel amplifier are turned off, if the third pixel data, the fourth pixel data and the sixth pixel data are identical to each other, and the first data difference, the second data difference, and a third data difference of the fifth pixel data and the sixth pixel data are respectively less than a second threshold value.

10. The display driving circuit of claim 9, wherein the first threshold value is greater than the second threshold value.

11. A display device comprising:

a display panel including a plurality of pixels arranged in a matrix form;

a data driver including, a first channel amplifier configured to drive a first data line connected to first pixels of the display panel based on first pixel data associated with a plurality of gate lines of the display panel, and a second channel amplifier configured to drive a second data line connected to second pixels of the display panel based on second pixel data associated with the plurality of gate lines; and a timing controller configured to compare first pixel data with second pixel data associated with a $(k+1)^{th}$ gate line (k is a positive integer) among the plurality of gate lines during a $k^{th}$ horizontal period, and to determine whether to turn on or turn off the second channel amplifier for a $(k+1)^{th}$ horizontal period based on a comparison result, before the $(k+1)^{th}$ horizontal period starts.

12. The display device of claim 11, wherein, the timing controller is configured to turn on the second channel amplifier before the $(k+1)^{th}$ horizontal period starts, if the second channel amplifier is off during the $k^{th}$ horizontal period and is to be turned on during the $(k+1)^{th}$ horizontal period.

13. The display device of claim 11, wherein the timing controller is configured to turn off the second channel amplifier during the $(k+1)^{th}$ horizontal period, if the first pixel data and the second pixel data of the $(k+1)^{th}$ line are identical to each other, and a data transition amount of the first pixel data between the $(k+1)^{th}$ gate line and a $k^{th}$ gate line and a data transition amount of the second pixel data between the $(k+1)^{th}$ gate line and a $k^{th}$ gate line are respectively less than a threshold value.

14. The display device of claim 11, wherein the data driver further comprises:

a shift register configured to sequentially receive a plurality of control signals for controlling operation states of the first channel amplifier and the second channel amplifier from the timing controller, and to provide the plurality of control signals to the first channel amplifier and the second channel amplifier.

15. A driving circuit configured to drive a display panel during at least a first horizontal period and a second horizontal period, the driving circuit comprising:

a controller configured to determine which ones of a first channel amplifier and a second channel amplifier to enable to amplify pixel data associated with a second gate line of the display panel during the second horizontal period based on the pixel data associated with a first gate line and the second gate line during the first horizontal period such that ones of the first channel amplifier and the second channel amplifier that are disabled during the first horizontal period and determined to be enabled during the second horizontal period are re-enabled prior to a start of the second horizontal period.

16. The driving circuit of claim 15, wherein the controller is configured to, determine, prior to the start of the second horizontal period, that an operation state of the second channel amplifier is reactivated during the second horizontal period, if the pixel data associated with the first gate line and the second gate line indicates that the second channel amplifier is off during the first horizontal period and on during the second horizontal period, and enable the second channel amplifier for the second horizontal period at least a stabilization time period prior to the start of the second horizontal period, if the controller determines that the operation state of the second channel amplifier is reactivated during the second horizontal period.

17. The driving circuit of claim 16, wherein the controller is configured to, determine, prior to the start of the second horizontal period, that the operation state of the second channel amplifier is deactivated during the second horizontal period, if the pixel data associated with the first gate line and the second gate line indicates that the second channel amplifier is on during the first horizontal period and off during the second horizontal period, and disable the second channel amplifier for the second horizontal period after the start of the second horizontal period, if the controller determines that the operation state of the second channel amplifier is deactivated during the second horizontal period.

18. The driving circuit of claim 15, wherein the pixel data transmitted to the first channel amplifier is first pixel data, and the pixel data transmitted to the second channel amplifier is second pixel data, the controller is further configured to, determine whether a first condition is true, the first condition being true if a value of the first pixel data associated with the second gate line is same as a value of the second pixel data associated with the second gate line, and determine whether a second condition is true, the second condition being true if a difference in the value of the first pixel data between the first horizontal period and the second horizontal period is less than a threshold, determine whether a third condition is true, the third condition being true if a difference in the value of the second pixel data between the first horizontal period and the second horizontal period is less than the threshold, and disable one of the first channel amplifier and the second channel amplifier for the second horizontal period, if the controller determines that the first condition, the second condition, and the third condition are true.

19. The driving circuit of claim 15, wherein the controller is configured to enable the second channel amplifier a time period before the second horizontal period begins, if the second channel amplifier is disabled during the first horizontal period and the controller determines that an operation state of the second channel amplifier is re-activated during the second horizontal period, the time period being set based on a stabilization time period associated with the second channel amplifier.

* * * * *